US011017736B2

(12) United States Patent
Kim et al.

(10) Patent No.: US 11,017,736 B2
(45) Date of Patent: May 25, 2021

(54) DISPLAY DEVICE

(71) Applicant: SAMSUNG DISPLAY CO., LTD., Yongin-si (KR)

(72) Inventors: Boyeon Kim, Seoul (KR); Wontae Kim, Hwaseong-si (KR); Taegon Im, Gwangmyeong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 83 days.

(21) Appl. No.: 15/646,536

(22) Filed: Jul. 11, 2017

(65) Prior Publication Data

US 2018/0012553 A1 Jan. 11, 2018

(30) Foreign Application Priority Data

Jul. 11, 2016 (KR) ..... 10-2016-0087588

(51) Int. Cl.
*G09G 3/36* (2006.01)

(52) U.S. Cl.
CPC ..... *G09G 3/3614* (2013.01); *G09G 3/3607* (2013.01); *G09G 3/3688* (2013.01); *G09G 2300/0814* (2013.01); *G09G 2300/0842* (2013.01); *G09G 2310/027* (2013.01); *G09G 2310/08* (2013.01); *G09G 2330/06* (2013.01)

(58) Field of Classification Search
None
See application file for complete search history.

(56) References Cited

U.S. PATENT DOCUMENTS 8,035,634 B2 * 10/2011 Yamazaki ..... G06F 3/0412 345/212
8,059,218 B2 11/2011 Yoshida
(Continued)

FOREIGN PATENT DOCUMENTS

CN 101878502 11/2010
CN 104252852 12/2014
(Continued)

OTHER PUBLICATIONS

Office Action dated Oct. 20, 2020 in corresponding Chinese Application No. 201710560499.5 (9 pages) (in Chinese).

*Primary Examiner* — Parul H Gupta
(74) *Attorney, Agent, or Firm* — F. Chau & Associates, LLC

(57) ABSTRACT

A display device may include a data driver that outputs a previous data voltage and a current data voltage, respectively, at an output terminal, to be applied to a pixel of a display panel in respective time intervals. A switch is controlled to open and close a circuit path between the output terminal and a data line coupled to the pixel. A capacitor stores an overdriving voltage. At least one further switch selectively applies the overdriving voltage to the data line from the capacitor when the circuit path is open and thereby enables a rapid transition of a voltage level of the data line between the previous and current data voltages, when the current and previous data voltages are to differ by more than a predetermined amount. As an example, the rapid transition between the previous and current data voltages may serve to minimize a color mixture phenomenon between pixels connected to a common data line and representing different colors.

18 Claims, 16 Drawing Sheets

(56) References Cited

U.S. PATENT DOCUMENTS

| | | | | |
|---|---|---|---|---|
| 8,411,005 | B2 | 4/2013 | Park et al. | |
| 9,361,849 | B2 | 6/2016 | Park et al. | |
| 9,934,729 | B2 * | 4/2018 | Hong | G09G 3/325 |
| 2005/0219187 | A1 * | 10/2005 | Shih | G09G 3/3659<br>345/94 |
| 2006/0061540 | A1 * | 3/2006 | Harada | G09G 3/3677<br>345/103 |
| 2007/0057887 | A1 * | 3/2007 | Itakura | G09G 3/3655<br>345/90 |
| 2008/0180385 | A1 * | 7/2008 | Yoshida | G09G 3/3413<br>345/102 |
| 2009/0058780 | A1 * | 3/2009 | Fukano | G09G 3/3655<br>345/90 |
| 2009/0141202 | A1 * | 6/2009 | Yoshida | G09G 3/3648<br>349/38 |
| 2015/0002503 | A1 * | 1/2015 | Park | G09G 3/3688<br>345/212 |

FOREIGN PATENT DOCUMENTS

| | | |
|---|---|---|
| KR | 10-20080060412 | 7/2008 |
| KR | 1020080062677 | 7/2008 |
| KR | 1020100122625 | 11/2010 |

* cited by examiner

DISPLAY DEVICE

CROSS-REFERENCE TO RELATED APPLICATION

This application claims priority under 35 U.S.C. § 119 to Korean Patent Application No. 10-2016-0087588, filed on Jul. 11, 2016, in the Korean Intellectual Property Office (KIPO), the disclosure of which is incorporated by reference herein in its entirety.

1. Technical Field

Exemplary embodiments relate to a display device, and more particularly, to a display device capable of improving image quality.

2. Discussion of Related Art

Liquid crystal display ("LCD") devices are among the most widely used types of flat panel display ("FPD") devices in consumer electronics today. An LCD device includes two substrates on which electrodes are formed, and a liquid crystal layer interposed therebetween. An LCD device may adjust an amount of transmitted light by applying voltage to two electrodes to rearrange liquid crystal molecules of the liquid crystal layer.

SUMMARY

Exemplary embodiments are directed to a display device that may improve image quality.

According to an exemplary embodiment, a display device includes: a timing controller outputting an overdriving control signal based on image data signals from a system; a switch controller outputting a first switch control signal and a second switch control signal based on a polarity control signal, a source output enable signal, a vertical synchronization signal and an overdriving control signal from the timing controller; a capacitor; a first switch controlled according to the first switch control signal from the switch controller and connected between one terminal of the capacitor and a first data line; a second switch controlled according to the second switch control signal from the switch controller and connected between another terminal of the capacitor and the first data line; a data driver generating a first previous data voltage and a first current data voltage based on a first previous image data signal and a first current image data signal from the timing controller and outputting the first previous data voltage and the first current data voltage through a first output terminal; and a third switch controlled according to a third switch control signal from the timing controller and connected between the first output terminal and the first data line.

The display device may further include a gray level generator generating a plurality of positive polarity gray level voltages and a plurality of negative polarity gray level voltages and applying the plurality of positive polarity gray level voltages and the plurality of negative polarity gray level voltages to the data driver.

During a first half of a vertical blanking period defined by the vertical synchronization signal, the switch controller may output, based on a level of the polarity control signal, one of the first switch control signal and the second switch control signal in an active level and the other of the first switch control signal and the second switch control signal in an inactive level, and the timing controller may output the third switch control signal of an inactive level.

During a second half of the vertical blanking period, the switch controller may output the first switch control signal of an inactive level and the second switch control signal of an inactive level, the timing controller may output the third switch control signal having an active level, and the data driver may output an initialization voltage through the first output terminal.

The image data signals input to the timing controller may include previous image data signals and current image data signals, and the timing controller may output the overdriving control signal having an active level when each of the previous image data signals is greater than or equal to a first reference value and each of the current image data signals is less than or equal to a second reference value.

The first reference value may have a digital value corresponding to an intermediate gray level voltage and the second reference value may have a digital value corresponding to a minimum gray level voltage.

During a horizontal blanking period defined by the source output enable signal, when the overdriving control signal having an active level is output from the timing controller, the switch controller may output, during the horizontal blanking period, based on a level of the polarity control signal, one of the first switch control signal and the second switch control signal in an active level and the other of the first switch control signal and the second switch control signal in an inactive level, and the timing controller may output the third switch control signal of an inactive level during the horizontal blanking period.

The switch controller may output the first switch control signal having an active level and the second switch control signal of an inactive level when the polarity control signal has a first level, and the switch controller may output the first switch control signal of an inactive level and the second switch control signal having an active level when the polarity control signal has a second level.

During a horizontal blanking period between an output period of the first previous data voltage and an output period of the first current data voltage, the switch controller may output one of the first switch control signal having an active level and the second switch control signal of an inactive level.

The display device may further include a selection unit selecting one of a first reference voltage and a second reference voltage based on the polarity control signal during a horizontal blanking period defined by the source output enable signal; and a comparator comparing the reference voltage selected by the selection unit with a voltage of the first data line and applying a comparison signal to the switch controller during the horizontal blanking period.

The switch controller may output the first switch control signal of an inactive level and the second switch control signal of an inactive level when the comparison signal of an active level is output from the comparator.

The display device may further include a first comparator comparing a voltage of the one terminal of the capacitor with a first reference voltage and outputting a first comparison signal based on the comparison result; a second comparator comparing a voltage of the other terminal of the capacitor with a second reference voltage and outputting a second comparison signal based on the comparison result; and an overdriving interrupter outputting an overdriving interruption signal based on the first and second comparison signals from the first and second comparators and applying the overdriving interruption signal to the switch controller.

The first reference voltage may have a substantially same magnitude as a magnitude of a minimum negative polarity gray level voltage and the second reference voltage may have a substantially same magnitude as a magnitude of a minimum positive polarity gray level voltage.

The overdriving interrupter may output the overdriving interruption signal of an active level when at least one of the first and second comparison signals has an active level, and the switch controller may output the first switch control signal of an inactive level and the second switch control signal of an inactive level according to the overdriving interruption signal of the active level.

The display device may further include a fourth switch controlled according to the first switch control signal from the switch controller and connected between said another terminal of the capacitor and a second data line; a fifth switch controlled according to the second switch control signal from the switch controller and connected between said one terminal of the capacitor and the second data line; and a sixth switch controlled according to the third switch control signal from the timing controller and connected between a second output terminal of the data driver and the second data line. The data driver may generate a second previous data voltage and a second current data voltage based on a second previous image data signal and a second current image data signal from the timing controller and sequentially output the second previous data voltage and the second current data voltage through the second output terminal. The first previous data voltage may have an opposite polarity to a polarity of the second previous data voltage and the first current data voltage may have an opposite polarity to a polarity of the second current data voltage During the first half of the vertical blanking period, the first switch and the fourth switch may be turned on and the second switch, the third switch and the fifth switch may be turned off by the switch controller, a voltage from the first data line may be applied to said another terminal of the capacitor through the turned-on first switch and a voltage from the second data line may be applied to said another terminal of the capacitor through the turned-on fourth switch, and the voltage of the first data line and a voltage of the second data line may have mutually opposite polarities.

According to an exemplary embodiment, a display device includes: a timing controller receiving image data signals from a system and outputting the image data signals; a data driver generating a first previous data voltage and a first current data voltage based on a first previous image data signal and a first current image data signal from the timing controller and sequentially outputting the first previous data voltage and the first current data voltage through a first output terminal; an overdriving determination unit outputting an overdriving control signal based on the first previous image data signal and the first current image data signal stored in the data driver; a switch controller outputting a first switch control signal and a second switch control signal based on a polarity control signal, a source output enable signal and a vertical synchronization signal from the timing controller and the overdriving control signal from the overdriving determination unit; a capacitor; a first switch controlled according to the first switch control signal from the switch controller and connected between one terminal of the capacitor and a first data line; a second switch controlled according to the second switch control signal from the switch controller and connected between another terminal of the capacitor and the first data line; and a third switch controlled according to a third switch control signal from the timing controller and connected between the first output terminal and the first data line.

The overdriving determination unit may output the overdriving control signal based on the first previous image data signal stored in a holding latch of the data driver and the first current image data signal stored in a sampling latch of the data driver.

At a falling edge timing of the source output enable signal, the overdriving determination unit may compare the first previous image data signal of the holding latch with the first current image data signal of the sampling latch At a rising edge timing of the source output enable signal, the overdriving determination unit may output the overdriving control signal based on the comparison result.

According to an exemplary embodiment, a display device comprising: a data driver configured to output a previous data voltage and a current data voltage, respectively, at an output terminal, to be applied to a pixel of a display panel, in respective time intervals; a switch controlled to open and close a circuit path between the output terminal and a data line coupled to the pixel; a capacitor to store an overdriving voltage; and at least one further switch to selectively apply the overdriving voltage to the data line when the circuit path is open and thereby enable a rapid transition of a voltage level of the data line between the previous and current data voltages, when the current and previous data voltages are to differ by more than a predetermined amount.

The data driver comprises a digital to analog (D/A) converter to D/A convert a previous image data signal and a current image data signal into the previous data voltage and the current data voltage, respectively.

The switch is a third switch and the at least one further switch comprises a first switch and a second switch connected to opposite terminals of the capacitor and selectively switched on at different times so as to provide different overdriving voltages to the data line.

The display device further comprises a timing controller configured to output an overdriving control signal based on image data signals from a system, in anticipation of the current and previous data voltages differing by more than the predetermined amount.

The data driver comprises a digital to analog (D/A) converter to D/A convert a previous image data signal and a current image data signal into the previous data voltage and the current data voltage, respectively; and The current and previous data voltages are anticipated to differ by more than the predetermined amount when the previous image data signal has a level above a first reference value and the current image data signal has a level below a second reference value, or vice versa.

The foregoing is illustrative only and is not intended to be in any way limiting. In addition to the illustrative aspects, exemplary embodiments and features described above, further aspects, exemplary embodiments and features will become apparent by reference to the drawings and the following detailed description.

BRIEF DESCRIPTION OF THE DRAWINGS

A more complete appreciation of the technology will become more apparent by describing in detail exemplary embodiments thereof with reference to the accompanying drawings, wherein.

DETAILED DESCRIPTION

Figure 1:
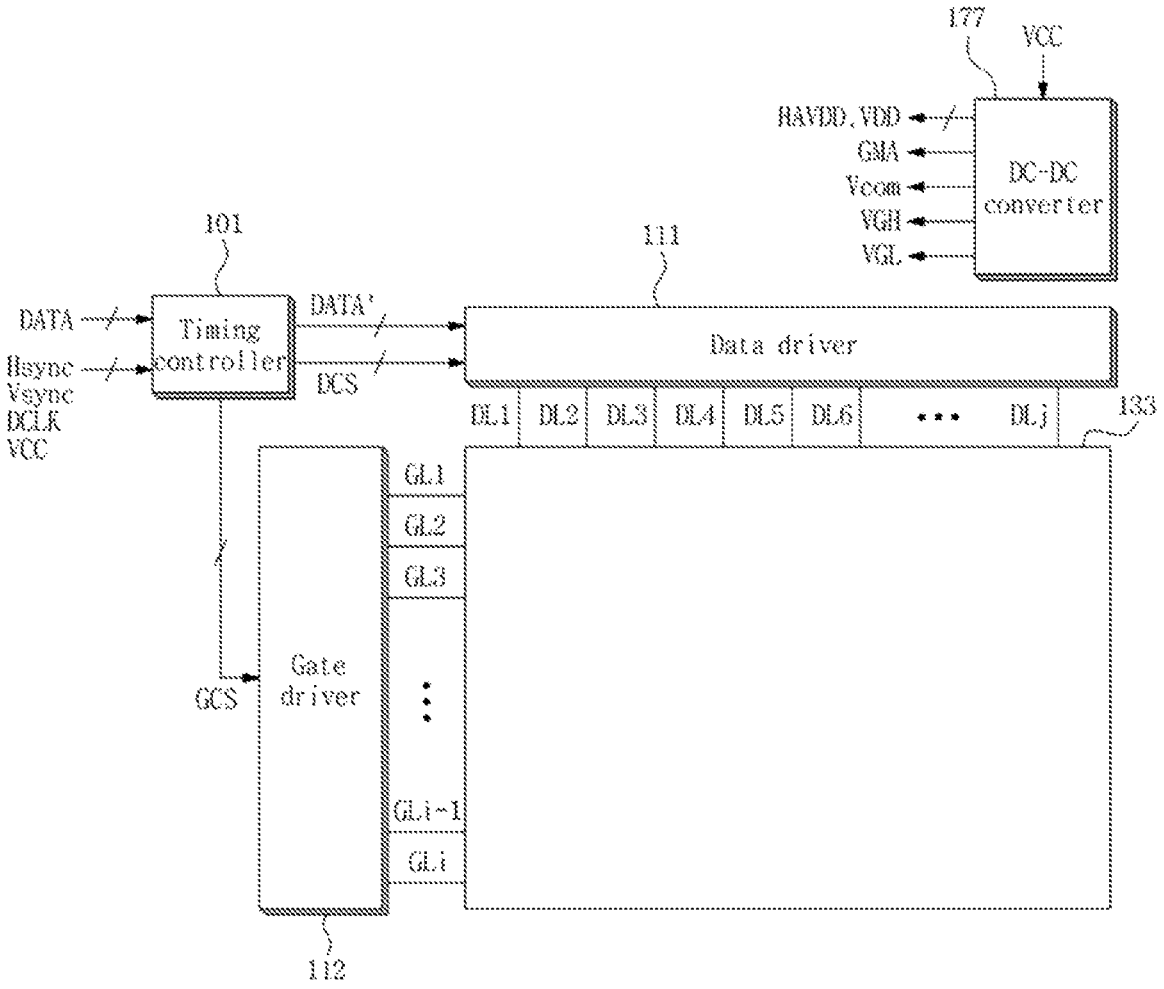
FIG. 1 is a block diagram illustrating a display device according to an exemplary embodiment.

Exemplary embodiments will now be described more fully hereinafter with reference to the accompanying drawings. Although the invention may be modified in various manners and have several exemplary embodiments, exemplary embodiments are illustrated in the accompanying drawings and will be mainly described in the specification. However, the scope of the invention is not limited to the exemplary embodiments and should be construed as including all of the changes, equivalents and substitutions encompassed within the spirit and scope of the claimed subject matter.

In the drawings, thicknesses of a plurality of layers and areas are illustrated in an enlarged manner for clarity and ease of description thereof. When a layer, area, or plate is referred to as being "on" another layer, area, or plate, it may be directly on the other layer, area, or plate, or intervening layers, areas, or plates may be present therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent therebetween.

The spatially relative terms "below", "beneath", "less", "above", "upper" and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in the other direction and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" may be termed likewise without departing from the teachings herein.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Some of the parts which are not associated with the description may not be provided in order to specifically describe exemplary embodiments according to the claimed subject matter and like reference numerals refer to like elements throughout the specification.

Hereinafter, display devices according to one or more exemplary embodiments will be described on the premise that they are a liquid crystal display ("LCD") device. However, the scope according to an exemplary embodiment is not limited to the LCD device and the present invention may be applicable to organic light emitting diode ("OLED") display devices, for example.

Hereinafter, a display device according to exemplary embodiments will be described in detail with reference to FIGS. 1 to 15.

Figure 2:
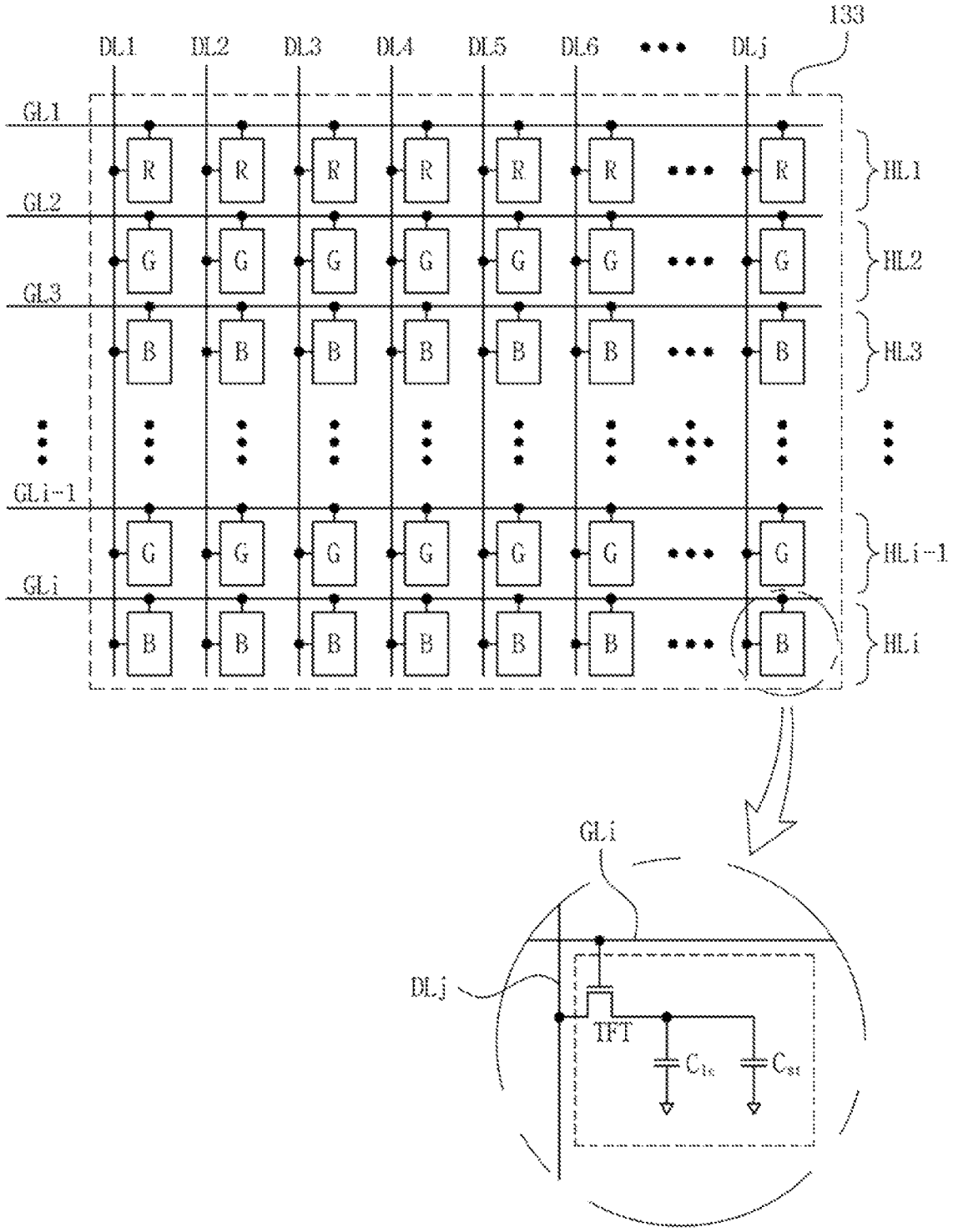
FIG. 2 is a detailed configuration view illustrating an example of a display panel illustrated in FIG. 1.

FIG. 1 is a block diagram illustrating a display device according to an exemplary embodiment and FIG. 2 is a detailed configuration view illustrating an example display panel illustrated in FIG. 1.

As illustrated in FIG. 1, the display device includes a display panel 133, a timing controller 101, a gate driver 112, a data driver 111 and a DC-DC converter 177.

The display panel 133 displays an image. The display panel 133 may be a liquid crystal display ("LCD") panel or an organic light emitting diode ("OLED") display panel. Hereinafter, an LCD panel will be described as the display panel 133 by way of example.

Although not illustrated, the display panel 133 includes a liquid crystal layer and a lower substrate and an upper substrate facing each other with the liquid crystal layer interposed therebetween.

A plurality of gate lines GL1 to GLi, a plurality of data lines DL1 to DLj intersecting the gate lines GL1 to GLi and thin film transistors ("TFTs") connected to the gate lines GL1 to GLi and the data lines DL1 to DLj are arranged at the lower substrate.

Although not illustrated, a black matrix, a plurality of color filters and a common electrode are disposed at the upper substrate. The black matrix is positioned at a portion of the upper substrate except portions thereof corresponding to pixel areas. The color filters are positioned at the pixel area. The color filters include a red color filter, a green color filter and a blue color filter.

As illustrated in FIG. 2, the pixels R, G and B are arranged in a matrix. The pixels R, G and B include a red pixel R positioned corresponding to the red color filter, a green pixel G positioned corresponding to the green color filter and a blue pixel B positioned corresponding to the blue color filter. In such an exemplary embodiment, the red pixel R, the green pixel G and the blue pixel B that are disposed adjacently in a vertical direction may define a unit pixel for displaying a unit image.

There are "j" number of pixels arranged along an n-th (n being one selected from 1 to i) horizontal line (hereinafter, n-th horizontal line pixels), which are connected to the first to j-th data lines DL1 to DLj, respectively. Further, the n-th horizontal line pixels are connected in common to the n-th gate line. Accordingly, the n-th horizontal line pixels receive an n-th gate signal as a common signal. That is, "j" number of pixels arranged in the same horizontal line receive the same gate signal, while pixels arranged in different horizontal lines receive different gate signals, respectively. For example, red pixels R in a first horizontal line HL1 all receive a first gate signal, while green pixels G in a second horizontal line HL2 receive a second gate signal that has a different timing from that of the first gate signal.

As illustrated in FIG. 2, each of the pixels R, G and B includes a TFT, a liquid crystal capacitor Clc and a storage capacitor Cst.

The TFT is turned on according to a gate signal applied from the gate line. The turned-on TFT applies an analog image data signal applied from the data line to the liquid crystal capacitor Clc and the storage capacitor Cst.

The liquid crystal capacitor Clc includes a pixel electrode and the common electrode which oppose each other.

The storage capacitor Cst includes the pixel electrode and an opposing electrode which oppose each other. In such an exemplary embodiment, the opposing electrode may be a previous gate line or a common line which transmits a common voltage.

In an exemplary embodiment, among the elements constituting the pixels R, G and B, the TFT is covered by a black matrix.

The timing controller 101 receives a vertical synchronization signal Vsync, a horizontal synchronization signal Hsync, an image data signal DATA and a reference clock signal DCLK output from a graphic controller provided in a system. An interface circuit (not illustrated) is provided between the timing controller 101 and the system and the aforementioned signals output from the system are input to the timing controller 101 through the interface circuit. The interface circuit may be embedded in the timing controller 101.

Although not illustrated, the interface circuit may include a low voltage differential signaling (LVDS) receiver. The interface circuit lowers voltage levels of the vertical synchronization signal Vsync, the horizontal synchronization signal Hsync, the image data signal DATA and the reference clock signal DCLK output from the system, while raising frequencies thereof.

In an exemplary embodiment, electromagnetic interference (EMI) may occur due to high frequency components of a signal input from the interface circuit to the timing controller 101. To prevent the EMI, an EMI filter (not illustrated) may be further provided between the interface circuit and the timing controller 101.

The timing controller 101 generates a gate control signal GCS for controlling the gate driver 112 and a data control signal DCS for controlling the data driver 111, using the vertical synchronization signal Vsync, the horizontal synchronization signal Hsync and the reference clock signal DCLK.

The gate control signal GCS includes a gate start pulse, a gate shift clock, a gate output enable signal, and the like. The data control signal DCS includes a source start pulse, a source shift clock, a source output enable signal, a polarity signal, and the like.

In addition, the timing controller 101 rearranges the image data signals DATA input through the system and applies the rearranged image data signals DATA' to the data driver 111.

In an exemplary embodiment, the timing controller 101 is driven by a driving power VCC output from a power unit provided in the system. For example, the driving power VCC is used as a power voltage of a phase lock loop ("PLL") circuit embedded in the timing controller 101. The PLL circuit compares the reference clock signal DCLK input to the timing controller 101 with a reference frequency generated from an oscillator. Then, in the case where it is identified from the comparison that there is a difference between them, the PPL circuit adjusts the frequency of the reference clock signal DCLK by the difference to generate a sampling clock signal. This sampling clock signal is a signal for sampling the image data signals DATA'.

The DC-DC converter 177 increases or decreases the driving power VCC input through the system to generate various voltages required for the display panel 133. To this end, the DC-DC converter 177 may include, for example, an output switching for switching an output voltage of an output terminal thereof and a pulse width modulator PWM for adjusting a duty cycle or a frequency of a control signal applied to a control terminal of the output switching so as to increase or decrease the output voltage. Alternatively, the DC-DC converter 177 may include a pulse frequency modulator PFM, instead of the pulse width modulator PWM.

The pulse width modulator PWM may increase the duty cycle of the aforementioned control signal to raise the output voltage of the DC-DC converter 177 or decrease the duty cycle of the control signal to lower the output voltage of the DC-DC converter 177. The pulse frequency modulator PFM may increase the frequency of the aforementioned control signal to raise the output voltage of the DC-DC converter 177 or decrease the frequency of the control signal to lower the output voltage of the DC-DC converter 177. The output voltage of the DC-DC converter 177 may include a reference voltage AVDD, a half reference voltage HAVDD, a gamma reference voltage GMA, a common voltage Vcom, a gate high voltage VGH and a gate low voltage VGL.

The gamma reference voltages GMA are voltages generated by voltage division of the reference voltage. The gamma reference voltages GMA are analog voltages, which are applied to the data driver 111. The common voltage Vcom is applied to the common electrode of the display panel 133 through the data driver 111. The gate high voltage VGH is a high logic voltage of a gate signal set to be higher than or equal to a threshold voltage of the TFT, and the gate low voltage VGL is a low logic voltage of the gate signal set to be an off voltage of the TFT. The gate high voltage VGH and the gate low voltage VGL are applied to the gate driver 112.

The gate driver 112 generates gate signals according to the gate control signal GCS provided from the timing controller 101 and sequentially applies the gate signals to the plurality of gate lines GL1 to GLi.

The gate driver 112 may include, for example, a shift register that shifts the gate start pulse according to the gate shift clock to generate gate signals. The shift register may include a plurality of switching elements. The switching elements may be formed on the lower substrate in a substantially same process through which the TFT in a display area is formed.

The data driver 111 receives the image data signals DATA' and the data control signals DCS from the timing controller 101. The data driver 111 samples the image data signals DATA' according to the data control signal DCS, sequentially latches the sampling image data signals corresponding to one horizontal line in each horizontal period and substantially simultaneously applies the latched image data signals to the data lines DL1 to DLj.

That is, the data driver 111 converts the image data signals DATA' applied from the timing controller 101 into analog image data signals, using the gamma reference voltages GMA input from the DC-DC converter 177, and applies the analog image data signals to the data lines DL1 to DLj. For example, the data driver 111 may include a gray level generator 300 (see FIG. 3). The gray level generator 300 generates a plurality of gray level voltages GV, using the half reference voltage HAVDD and the gamma reference voltages GMA applied from the DC-DC converter 177. The plurality of gray level voltages GV (see FIG. 3) include positive polarity gray level voltages and negative polarity gray level voltages that may represent digital data values which are the same as those represented by the positive polarity gray level voltages. For instance, the positive voltages may represent values from 0 to 255 (with increasing analog voltage) whereas the negative voltages also represent values from 0 to 255 (with decreasing analog voltage). The positive and negative polarity voltages may be applied to alternating odd and even columns (or channels) of pixels, respectively. The plurality of positive polarity gray level voltages have a voltage value greater than the half reference voltage HVADD and the plurality of negative polarity gray level voltages have a voltage value less than the half reference voltage HAVDD. Thus, "negative polarity" may be understood to mean negative relative to a positive reference voltage HVADD, but not relative to a reference ground. For instance, an example level for HVADD is 7.5 V, an example range for the positive polarity gray level voltages is from 8V to 14V, and an example range of the negative polarity gray level voltages is from 1V to 7V, all referenced to ground potential. Also, negative polarity voltage closest to HVADD (but of highest voltage relative to ground, e.g., 7V) may represent a minimum digital value of zero whereas a negative polarity voltage furthest from HVADD (but lowest voltage relative to ground, e.g., 1V) may represent a highest digital value such as 255. The data driver 111 converts the image data signals applied from the timing controller 101 into analog signals, using the positive polarity gray level voltages and the negative polarity gray level voltages.

In an exemplary embodiment, the gray level generator 300 may be positioned inside or outside the data driver 111.

Figure 3:
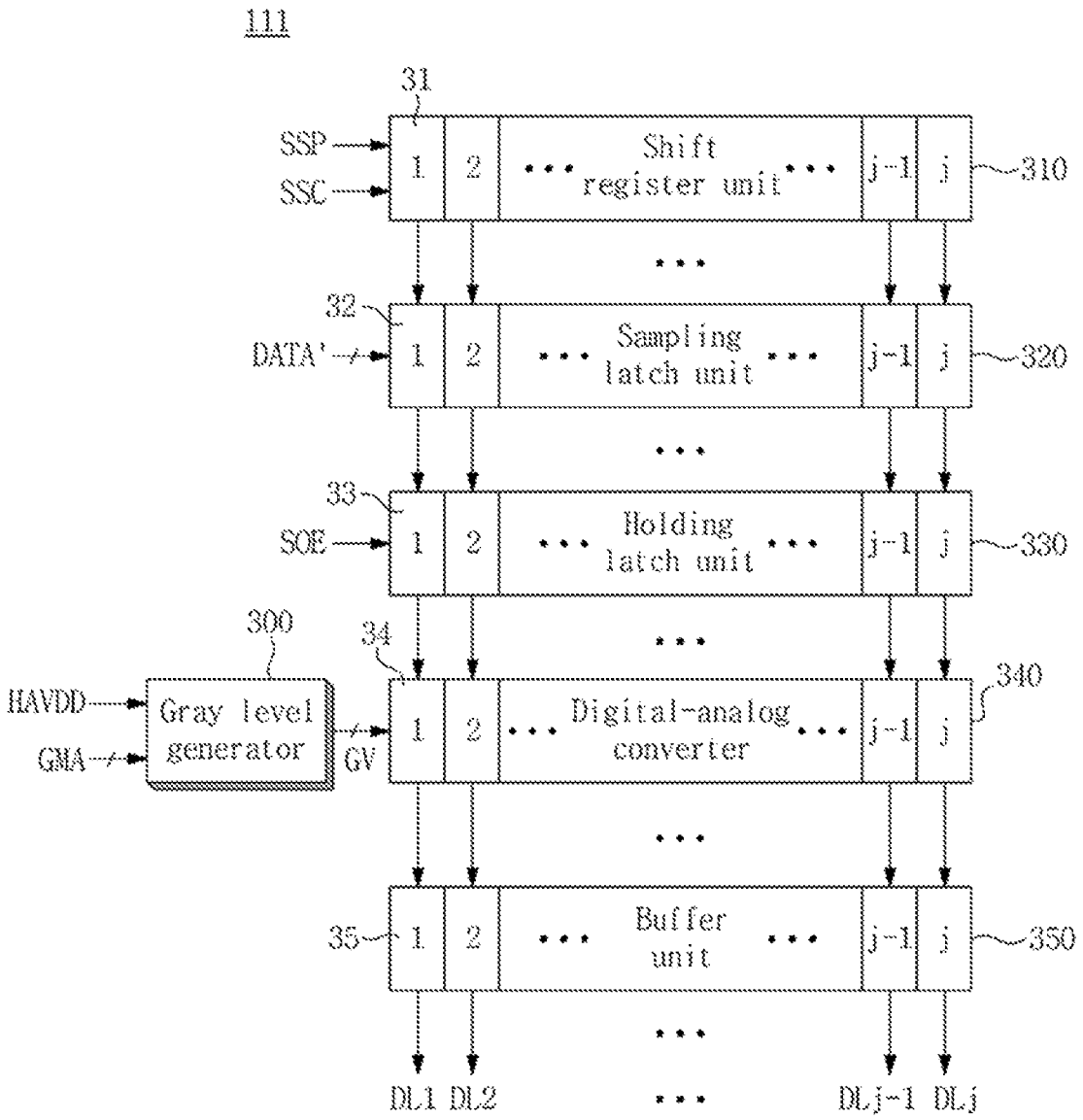
FIG. 3 is a detailed block diagram illustrating an example of the data driver of FIG. 1.

FIG. 3 is a detailed block diagram illustrating an example data driver 111 of FIG. 1. As illustrated in FIG. 3, the data driver 111 includes a shift register unit 310, a sampling latch unit 320, a holding latch unit 330, a gray level generator 300, a digital-analog converter 340 and a buffer unit 350.

The shift register unit 310 receives a source shift clock SSC and a source start pulse SSP from the timing controller 101 and shifts the source start pulse SSP at each period of the source shift clock SSC to thereby sequentially generate "j" number of sampling signals. To this end, the shift register unit 310 includes "j" number of shift registers 31.

The sampling latch unit 320 sequentially stores the digital image data signals in response to the sampling signals sequentially applied thereto from the shift register unit 310. Herein, the sampling latch unit 320 includes "j" number of sampling latches 32 for storing "j" number of digital image data signals. In this regard, each of the sampling latches 32 has a storage capacity corresponding to a bit value of the image data signal. For example, in the case where each of the image data signals is composed of "k" number of bits ("k" being a natural number), each of the sampling latches 32 has a storage capacity set to have a size of "k" number of bits.

The holding latch unit 330 substantially simultaneously receives the image data signals applied thereto from the sampling latch unit 320 to store the image data signals and substantially simultaneously outputs sampled digital image data signals that are stored in a previous period, in response to a source output enable signal ("SOE"). The image data signals output from the holding latch unit 330 are substantially simultaneously applied to the digital-analog converter 340. The holding latch unit 330 includes "j" number of holding latches 33 for storing "j" number of digital image data signals. In addition, each of the holding latches 33 has a storage capacity corresponding to a bit value of the image data signal. For example, in the case where each of the image data signals is composed of "k" number of bits ("k" being a natural number) as in the above, each of the holding latches 33 has a storage capacity set to have a size of "k" number of bits.

The gray level generator 300 divides the half reference voltage HAVDD and the gamma reference voltage GMA applied from the DC-DC converter 177 to thereby generate the plurality of positive polarity gray level voltages and the negative polarity gray level voltages.

The digital-analog converter 340 generates an analog image data signal corresponding to the bit value of the image data signal applied from the holding latch unit 340. For example, the digital-analog converter 340 selects a gray level voltage corresponding to the bit value of the digital image data signal applied from the holding latch unit 340 from the gray level generator 300 and outputs the selected gray level voltage as an analog image data signal. The digital-analog converter 340 includes "j" number of digital-analog converters 34 for converting the "j" number of digital image data signals into analog image data signals.

The buffer unit 350 receives the analog image data signals from the digital-analog converter 340, amplifies the analog image data signals and outputs the amplified analog image data signals to the data line DL1 to DLj of the display panel 133. The buffer unit 350 includes "j" number of buffers 35 for amplifying "j" number of analog image data signals.

Exemplary embodiments of a display device may further include overdrive circuitry that includes a capacitor, a plurality of switches, a switch controller and the like for overdriving, which will be described in detail with reference to FIG. 4. Briefly, overdriving is achieved by transferring charge from the capacitor using the switches onto a data line DLi (any one of data lines DL1-DLj). The overdriving serves to rapidly increase or decrease, a voltage level on a data line DLi when a difference between previous and current data voltages is relatively large (and optionally satisfies other predetermined criteria such as discussed in reference to FIG. 6). Thus, with overdriving, the transition speed to reach a target voltage level on the data line is increased. The increase in transition speed between voltage levels may minimize a color mixture phenomenon between different color pixels connected to one data line. On the other hand, "normal driving" is performed and overdriving is not performed when the difference between the previous and current data voltages is relatively small or does not satisfy the predetermined criteria.

In an exemplary embodiment, various signals to be described below may have an active level or an inactive level. In general, when a signal having an active level is applied to another type of component, a driving unit that receives the signal of the active level may perform a specific operation of that component (for example, an overdriving operation). On the other hand, when a signal has the inactive level, a driving unit that receives the signal of the inactive level does not cancel the specific operation (for example, the overdriving operation) or does not perform the specific operation.

In addition, when a signal having an active level is applied to a switch, the switch that receives the signal may be turned on (closed). On the other hand, when a signal having an inactive level is applied to a switch, the switch that receives the signal of the inactive level may be turned off (opened).

Figure 4:
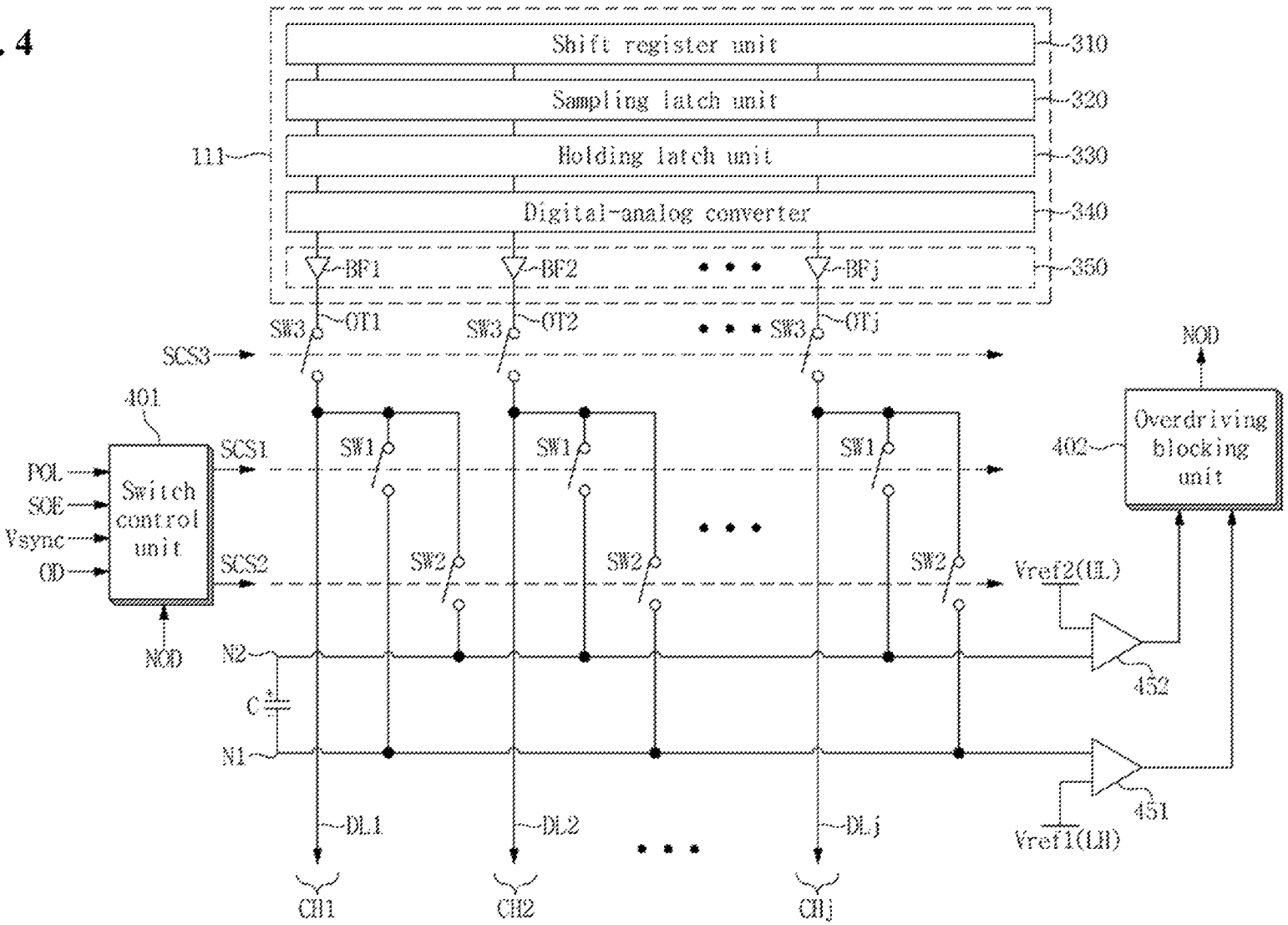
FIG. 4 is a schematic diagram illustrating an example data driver of FIG. 3 and components for overdriving.
Figure 5:
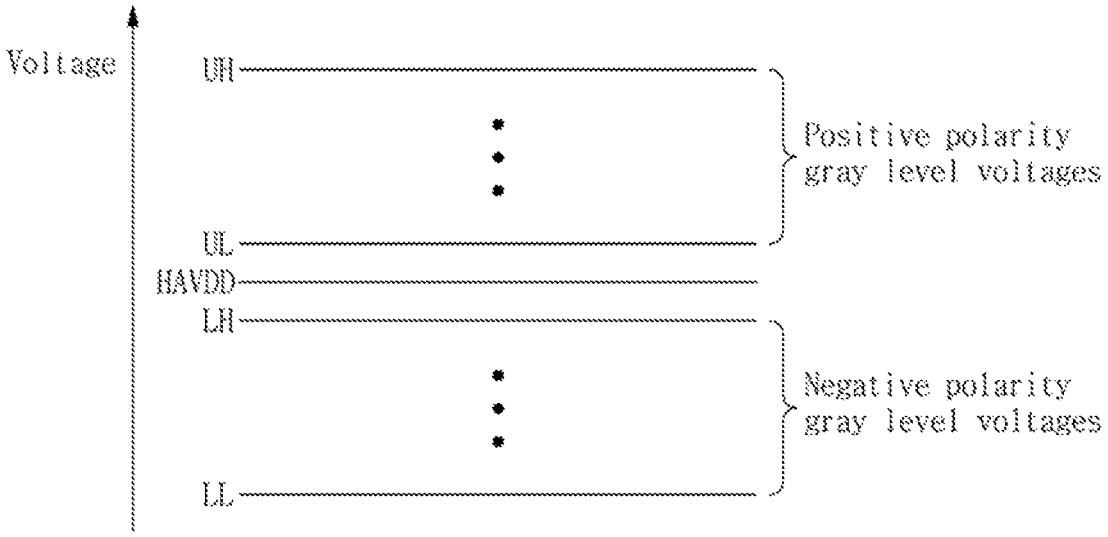
FIG. 5 is a diagram illustrating the magnitude relationship between positive polarity gray level voltages and negative polarity gray level voltages.

FIG. 4 is a schematic diagram illustrating an example data driver of FIG. 3 and components for overdriving, and FIG. 5 is a diagram illustrating an example magnitude relationship between positive polarity gray level voltages and negative polarity gray level voltages.

As illustrated in FIG. 4, the display device according to an exemplary embodiment may further include a capacitor C, a plurality of switches SW1, SW2 and SW3, a switch controller 401, an overdriving interrupter 402, a first comparator 451 and a second comparator 452.

The data driver 111 includes a plurality of output terminals OT1 to OTj (respective output terminals of the buffers BF1 to BFj) corresponding to the data lines DL1 to DLj, and respective ones of the output terminals OT1 to OTj of the data driver 111 are respective output terminals OT1 to OTj of the buffers BF1 to BFj.

Based on a polarity control signal POL, the source output enable signal SOE, the vertical synchronization signal Vsync and an overdriving control signal OD applied from the timing controller 101, the switch controller 401 outputs a first switch control signal SCS1 controlling switches SW1 and a second switch control signal SCS2 controlling switches SW2.

The capacitor C stores an overdriving voltage used for overdriving, and this overdriving voltage is applied to a data line DLi of which the previous data voltage to current data voltage difference exceeds a threshold (and optionally other criteria). For example, one terminal N1 of the capacitor C may maintain a negative polarity overdriving voltage due to the capacitor C and another terminal N2 of the capacitor C may maintain a positive polarity overdriving voltage due to the capacitor C. As noted above, a negative polarity overdriving voltage may be a positive polarity relative to ground (e.g., 1V-7V) whereas the positive polarity voltage may be a higher voltage relative to ground (e.g., 8V-14V). Briefly, when an overdriving condition is activated, the switches SW1, SW2 and SW3 are controlled to close a circuit path from the terminal N1 or N2 of the capacitor C to the data line DLi, during the next horizontal blanking period following a period of the previous data voltage. This enables a fast transition between voltage levels of the previous and current data voltage periods so that the current data voltage will reach its target level faster.

Figure 8A:
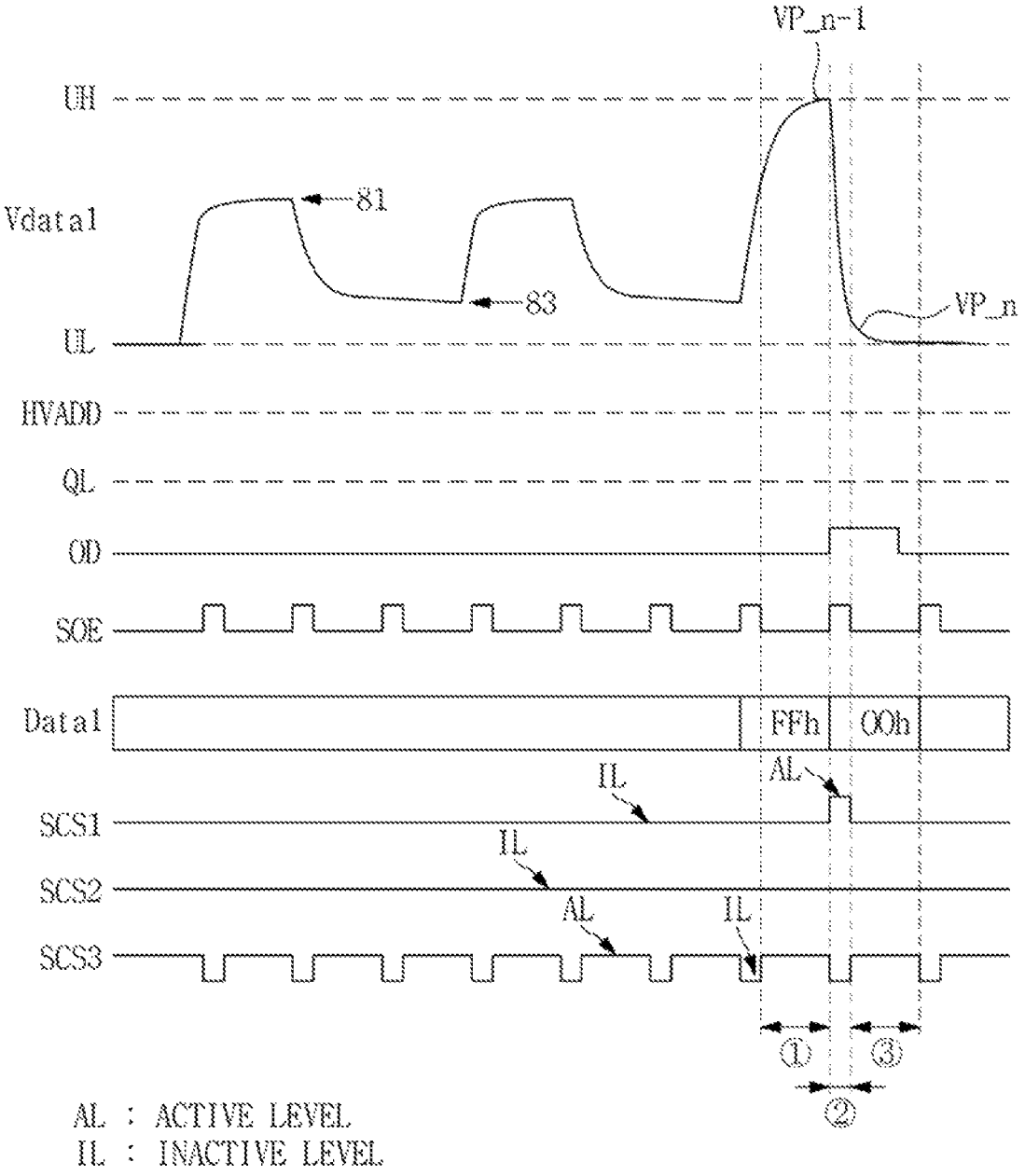
FIG. 8A is a signal and timing diagram illustrating voltage variation of a first data line due to the overdriving in FIGS. 7A and 7B.

To facilitate an understanding of the circuitry of FIG. 4, reference is made temporarily to FIG. 8A, in which an example of such a fast transition is illustrated for a first channel CH1 with data line DL1. The voltage Vdata1 represents the voltage on the data line DL1. A time period ① represents a time period of a previous data voltage (an analog voltage) in which Vdata1 has the value of VP_n−1 and appears on data line DL1. The data voltage VP_n−1 is an analog representation of a previous data signal "Data1" having a digital value of FFh (FF hex) representing a maximum level of 255. Prior to or at the time of an A/D conversion of a current data signal having a value of 00h representing a minimum value of 0, it is known or determined that the difference between the previous data voltage and the current data voltage will be large, such that an overdrive condition should be triggered to reduce the time for the voltage transition.

Figure 8B:
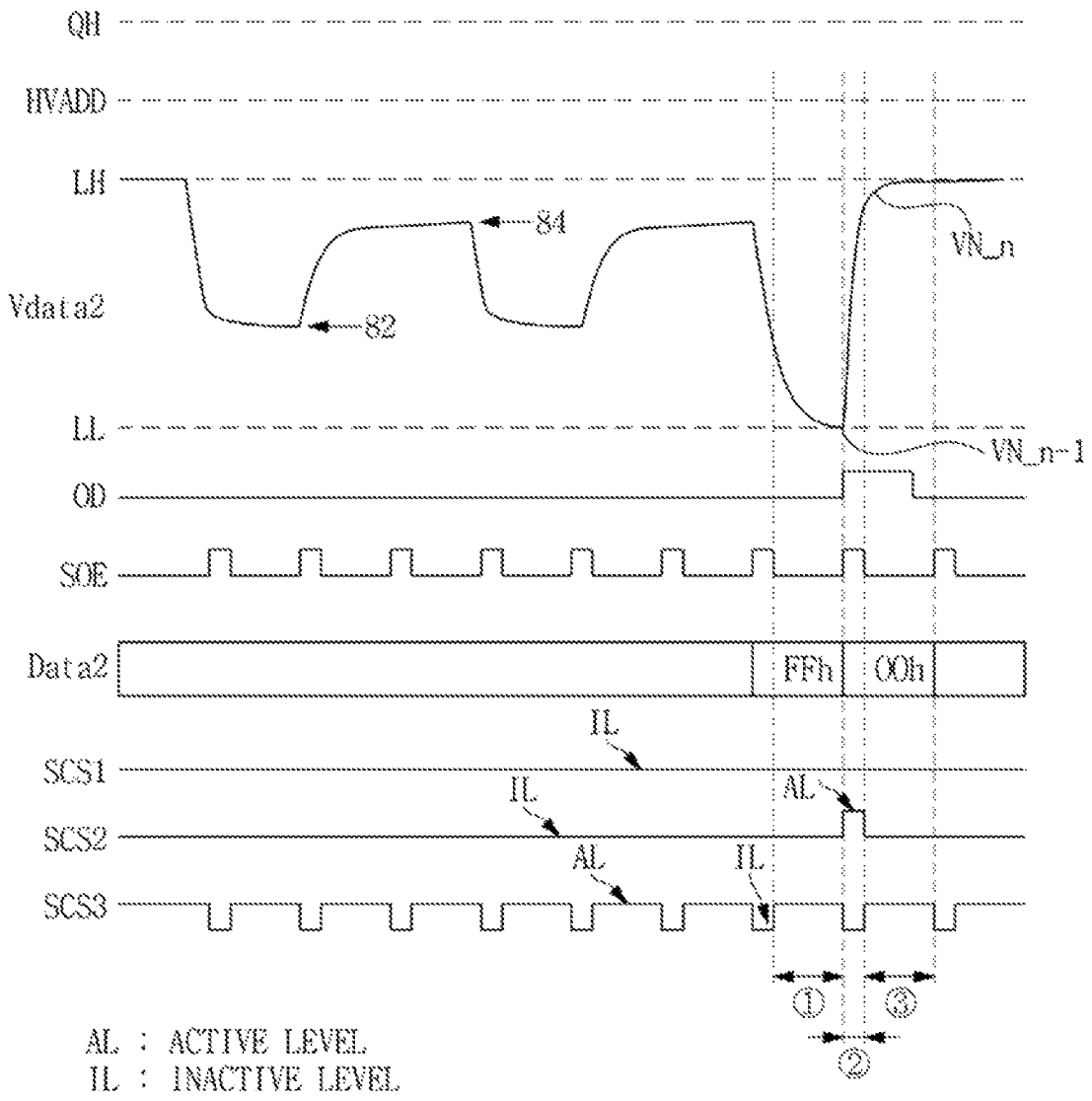
FIG. 8B is a signal and timing diagram illustrating voltage variation of a second data line due to the overdriving in FIGS. 7A and 7B.

The period ③ corresponds to a period of a current data voltage, where Vdata1 equals VP_n, and the period ② corresponds to a horizontal blanking period in between the previous and current data voltage periods ① and ③. At the start of period ②, an overdrive pulse OD is applied, which results in the switch SW3 being open (by virtue of the inactive level of the SW3 control signal SCS3) and the switch SW1 being closed (by virtue of the active level of the switch signal SCSI). Thus, the terminal N1 of the capacitor C is connected to the data line DL1, which rapidly reduces the voltage Vdata1 from a high level UH (corresponding to the maximum level 255 or FFh) towards a low level UL (corresponding to 00h or 0), as seen in the period ②. Then, at the start of period ③, the switch SW3 is turned on (closed) and switch SW2 is opened, so that the voltage (at or close to the level UL) on the output terminal OT1 is transferred to data line DL1 and the voltage on DL1 shortly thereafter reaches UL. Moreover, capacitor C may be recharged in a vertical blanking period described below. Analogous operations may be performed for negative polarity voltages (as illustrated in FIG. 8B), by selectively switching a connection path from terminal N2 of capacitor C to the data line DLi, to speed up a low to high voltage transition between previous and current data voltages. Accordingly, the overdriving circuitry of the present embodiments provides compact circuitry for achieving a desired result of fast voltage transitions on data lines when previous and current voltages having large differences.

In some cases, it is desirable to minimize a color mixture phenomenon that occurs in an entire horizontal row. In this situation, an overdriving circuit configuration such as that of FIG. 4 may be utilized, in which all switches of a common type (e.g. SW1) are controlled closed or open in the same manner simultaneously. Thus the same effective overdriving condition may be applied to all channels of the display panel concurrently. In other cases, it is desirable to minimize the color mixture phenomenon for each channel independently. In this case, an overdriving circuit configuration such as that of FIG. 10 may be employed, in which overdriving is determined and controlled for each channel individually.

With continuing reference to FIG. 4, the positive polarity overdriving voltage may be substantially the same as one of the above-described positive polarity gray level voltages. The negative polarity overdriving voltage may be substantially the same as one of the above-described negative polarity gray level voltages.

As illustrated in FIG. 5, the positive polarity gray level voltages are gray level voltages that are higher than the half reference voltage HAVDD. Hereinafter, a positive polarity gray level voltage having a greatest difference from the half reference voltage HAVDD among the positive polarity gray level voltages is defined as a maximum positive polarity gray level voltage UH. A positive polarity gray level voltage having a smallest difference from the half reference voltage HAVDD among the positive polarity gray level voltages is defined as a minimum positive polarity gray level voltage UL.

The maximum positive polarity gray level voltage UH has a greatest value among the positive gray level voltages and the minimum positive polarity gray level voltage UL has a smallest value among the positive gray level voltages.

In the case where the positive polarity gray level voltages include 256 positive polarity gray level voltages having different levels, the aforementioned maximum positive polarity gray level voltage UH corresponds to a 256th gray level voltage (a gray level voltage 255) and the aforementioned minimum positive polarity gray level voltage UL corresponds to a first gray level voltage (a gray level voltage 0). The maximum positive polarity gray level voltage UH may be a voltage corresponding to a full white level (e.g. all 1's) and the minimum positive polarity gray level voltage UL may be a voltage corresponding to a full black level (e.g. all 0's).

As illustrated in FIG. 5, the negative polarity gray level voltages are gray level voltages less than the half reference voltage HAVDD. Hereinafter, a negative polarity gray level voltage having a greatest difference from the half reference voltage HAVDD among the negative polarity gray level voltages is defined as a maximum negative polarity gray level voltage LL and a negative polarity gray level voltage having a smallest difference from the half reference voltage HAVDD among the negative polarity gray level voltages is defined as a minimum negative polarity gray level voltage LH.

The maximum negative polarity gray level voltage LL has a smallest value among the negative polarity gray level voltages and the minimum negative polarity gray level voltage LH has a greatest value among the negative polarity gray level voltages.

In the case where the negative polarity gray level voltages include 256 negative polarity gray level voltages having different levels, the aforementioned maximum negative polarity gray level voltage LL corresponds to a 256th gray level voltage (a gray level voltage 255) and the aforementioned minimum negative polarity gray level voltage LH corresponds to a first gray level voltage (a gray level voltage 0). The maximum negative polarity gray level voltage LL may be a voltage corresponding to a full white level and the minimum negative polarity gray level voltage LH may be a voltage corresponding to a full black level.

For example, the half reference voltage HAVDD may be a DC voltage of about 7.5 V, the maximum positive polarity gray level voltage UH may be a DC voltage of about 14 V, the minimum positive polarity gray level voltage UL may be a DC voltage of about 8 V, the maximum negative polarity gray level voltage LL may be a DC voltage of about 1 V, and the minimum negative polarity gray level voltage LH may be a DC voltage of about 7 V.

The positive polarity overdriving voltage may be greater than the aforementioned minimum negative polarity gray level voltage LH or the half reference voltage HAVDD described above. For example, the positive polarity overdriving voltage may be substantially the same as one of the positive polarity gray level voltages described above.

The negative polarity overdriving voltage may be less than the aforementioned minimum positive polarity gray level voltage UL or the half reference voltage HAVDD described above. For example, the negative polarity overdriving voltage may be substantially the same as one of the negative polarity gray level voltages described above.

In the following discussion, switches SW1, SW2 and SW3 will be referred to as first, second and third switches, respectively. In the currently discussed embodiment, the first switches SW1 are controlled together by the first switch control signal SCS1 from the switch controller 401, and the second switches SW2 are controlled together by the second switch control signal SCS2 from the switch controller 401. The third switches SW3 may be controlled by a third switch control signal SCS3 from the timing controller 101.

An output terminal OTi and a data line DLi corresponding to each other, and a first switch SW1, a second switch SW2 and a third switch SW3 connected to the output terminal OTi and the data line DLi are included in any one channel "CHi".

For example, a first output terminal OT1 of the data driver 111, a first data line DL1, and first, second and third switches SW1, SW2 and SW3 connected to the first output terminal OT1 and the first data line DL1 are included in a first channel CH1.

The first switch SW1 of the first channel CH1 is controlled according to the first switch control signal SCS1 from the switch controller 401 and connected between the first data line DL1 and the one terminal N1 of the capacitor C.

The second switch SW2 of the first channel CH1 is controlled according to the second switch control signal SCS2 from the switch controller 401 and connected between the first data line DL1 and terminal N2 of the capacitor C.

The third switch SW3 of the first channel CH1 is controlled according to the third switch control signal SCS3 from the timing controller 101 and connected between the first data line DL1 and the first output terminal OT1.

Other channels also have a substantially same configuration as that of the first channel CH1 described above. However, the odd-numbered channel and the even-numbered channel have different configurations. For example, a first switch SW1 of a second channel CH2 is connected to terminal N2 of the capacitor C, rather than the one terminal N1 of the capacitor C, and a second switch SW2 of the second channel CH2 is connected to the one terminal N1, rather than terminal N2 of the capacitor C.

The odd-numbered channels may have a substantially same configuration as that of the first channel CH1 described above, and the even-numbered channels may have a substantially same configuration as that of the second channel CH2 described above. In an alternative exemplary embodiment, on the contrary, the odd-numbered channels may have a substantially same configuration as that of the above-described second channel CH2 and the even-numbered channels may have a substantially same configuration as that of the first channel CH1 described above.

A purpose of the comparators 451 and 452 and overdriving blocking unit (circuit) 402 is to determine if the stored voltages on the capacitor C terminals N1 and/or N2 are outside a predefined tolerance range. If so, the overdriving operations may be blocked via an output signal NOD of overdriving blocking unit 402, until the capacitors are recharged and the respective voltages on its terminals fall within the predefined range. To this end, the first comparator 451 compares a voltage of terminal N1 of the capacitor C with a first reference voltage Vref1 and outputs a first comparison signal based on the comparison result.

The first comparator 451 outputs a first comparison signal of the active level when the voltage of terminal N1 is higher than the first reference voltage Vref1. On the other hand, the first comparator 451 outputs a first comparison signal of the inactive level when the voltage of terminal N1 is lower than or equal to the first reference voltage Vref1.

The second comparator 452 compares a voltage of terminal N2 of the capacitor C with a second reference voltage Vref2 and outputs a second comparison signal based on the comparison result.

The second comparator 452 outputs a second comparison signal of the active level when the voltage of terminal N2 is lower than the second reference voltage Vref2. On the other hand, the second comparator 452 outputs a second comparison signal of the inactive level when the voltage of terminal N2 is higher than or equal to the second reference voltage Vref2.

The second reference voltage Vref2 may be higher than the first reference voltage Vref1. For example, the first reference voltage Vref1 may have a substantially same value as that of the minimum negative polarity gray level voltage LH and the second reference voltage Vref2 may have a substantially same value as that of the minimum positive polarity gray level voltage UL.

In some cases, smooth overdriving operation is achieved under a condition that the voltage of the one terminal N1 maintains at least the minimum negative polarity gray level voltage LH and the voltage of terminal N2 maintains at least the minimum positive polarity gray level voltage UL. The first and second comparators 451 and 452 described above identify whether the voltages of the opposite terminals N1 and N2 of the capacitor C have voltages suitable for overdriving.

Each of the first comparison signal from the first comparator 451 and the second comparison signal from the second comparator 452 is applied to the overdriving interrupter (blocking circuit) 402.

The overdriving interrupter 402 outputs an overdriving interruption signal NOD based on the first and second comparison signals from the first and second comparators 451 and 452. For example, when at least one of the first comparison signal and the second comparison signal has the active level, the overdriving interrupter 402 outputs an overdriving interruption signal NOD of the active level. That is, the overdriving interrupter 402 outputs the overdriving interruption signal NOD of the active level when at least one of the one terminal N1 and terminal N2 of the capacitor C does not maintain the overdriving voltage (the positive polarity overdriving voltage or the negative polarity overdriving voltage). The overdriving interruption signal NOD is applied to the switch controller 401.

The switch controller 401, when receiving the overdriving interruption signal NOD of the active level, does not perform an overdriving operation. In other words, in response to the overdriving interruption signal NOD of the active level, the switch controller 401 performs a normal operation rather than the overdriving operation. For example, when the overdriving interruption signal NOD of the active level is input to the switch controller 401, the switch controller 401 outputs the first switch control signal SCS1 of the inactive level and the second switch control signal SCS2 of the inactive level. Accordingly, the first and second switches SW1 and SW2 are turned off (open).

Figure 6:
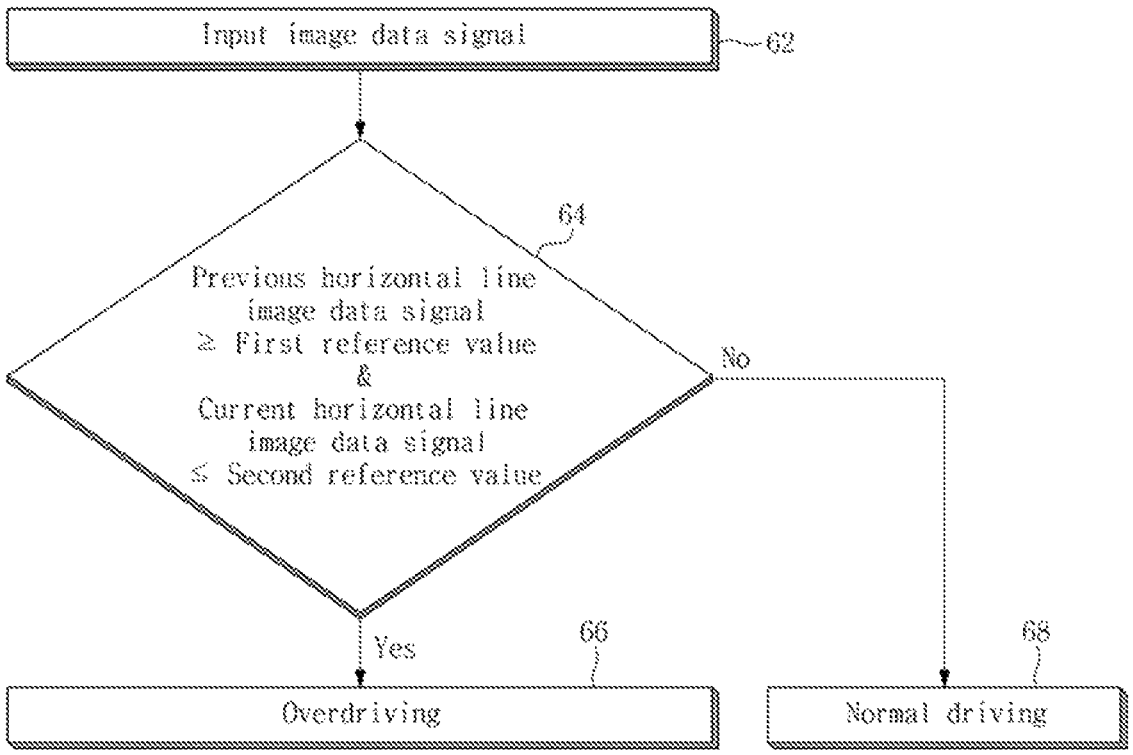
FIG. 6 is a flowchart illustrating a method of how a timing controller of FIG. 1 determines whether to perform overdriving.

FIG. 6 is a flowchart illustrating an example method of how the timing controller of FIG. 1 determines whether to perform overdriving.

Image data signals are input (62) to the timing controller 101, which outputs the overdriving control signal OD based on the image data signals from the system. For example, the timing controller 101 compares (64) each of image data signals of a previous horizontal line among the image data signals with the first reference value and compares each of image data signals of a current horizontal line among the image data signals with the second reference value.

In the case where a condition is satisfied in which each of the image data signals of the previous horizontal line is greater than or equal to the first reference value and each of the image data signals of the current horizontal line is less than or equal to the second reference value, the timing controller 101 outputs (66) the overdriving control signal OD of the active level. This condition also corresponds to a difference between the previous and current data voltages being above a threshold. On the other hand, in the case where the above condition is not satisfied, the timing controller 101 outputs the overdriving control signal OD of the inactive level (68) so that normal driving is performed.

As an example, the first reference value may be greater than the second reference value. In such an exemplary embodiment, the first reference value may have a digital value corresponding to an intermediate gray level voltage (for example, a gray level voltage 128) and the second reference value may have a digital value corresponding to a lowest gray level voltage (for example, a gray level voltage 0).

As another example, the first reference value and the second reference value may be substantially the same as each other or, alternatively, the second reference value may be greater than the first reference value. In general, if an anticipated analog voltage difference between the previous and current data voltages is predicted (e.g. from the digital data values of the image data signals) or otherwise determined, an overdrive operation may be initiated to speed up the voltage transition between the two levels on the data line DLi.

When the overdriving control signal OD of the active level is output from the timing controller 101, an overdriving operation is performed for the image data signals of the current horizontal line. On the other hand, when the overdriving control signal OD of the inactive level is output from the timing controller 101, no overdriving operation is performed for the image data signals of the current horizontal line.

Figure 7A:
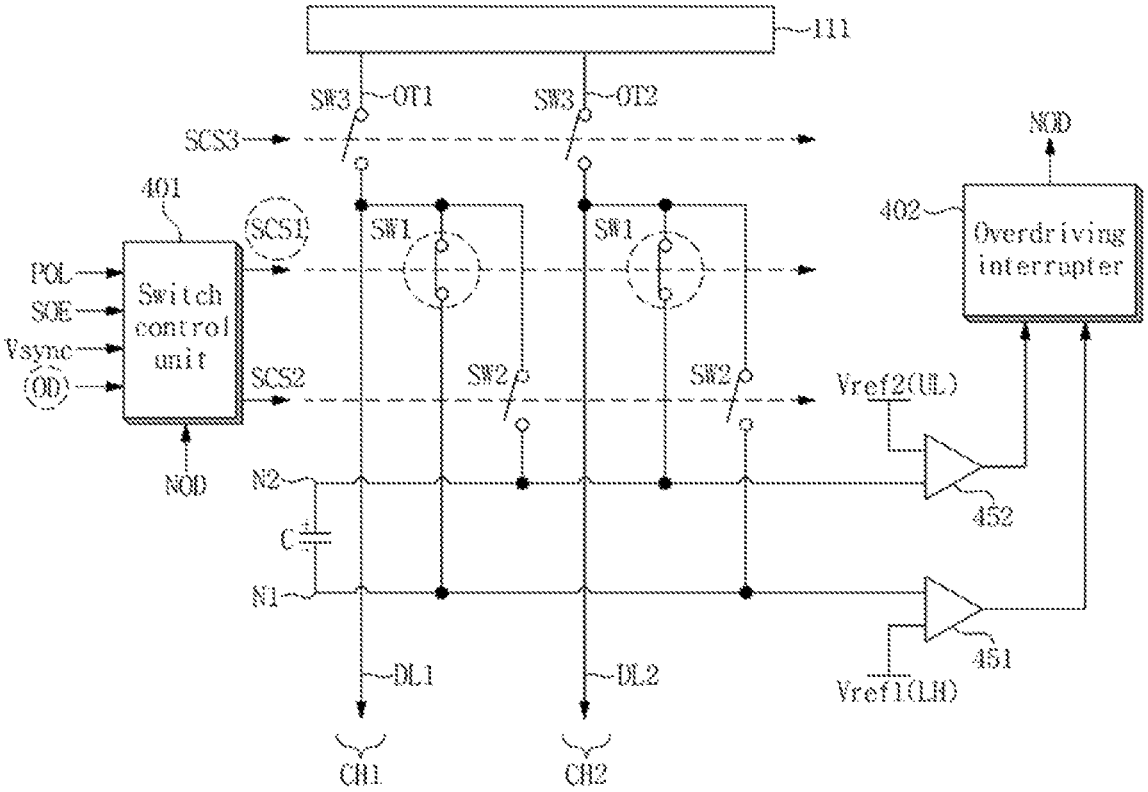
FIGS. 7A and 7B are each a diagram illustrating driving of first, second and third switches included in each of two adjacent channels during overdriving.
Figure 7B:
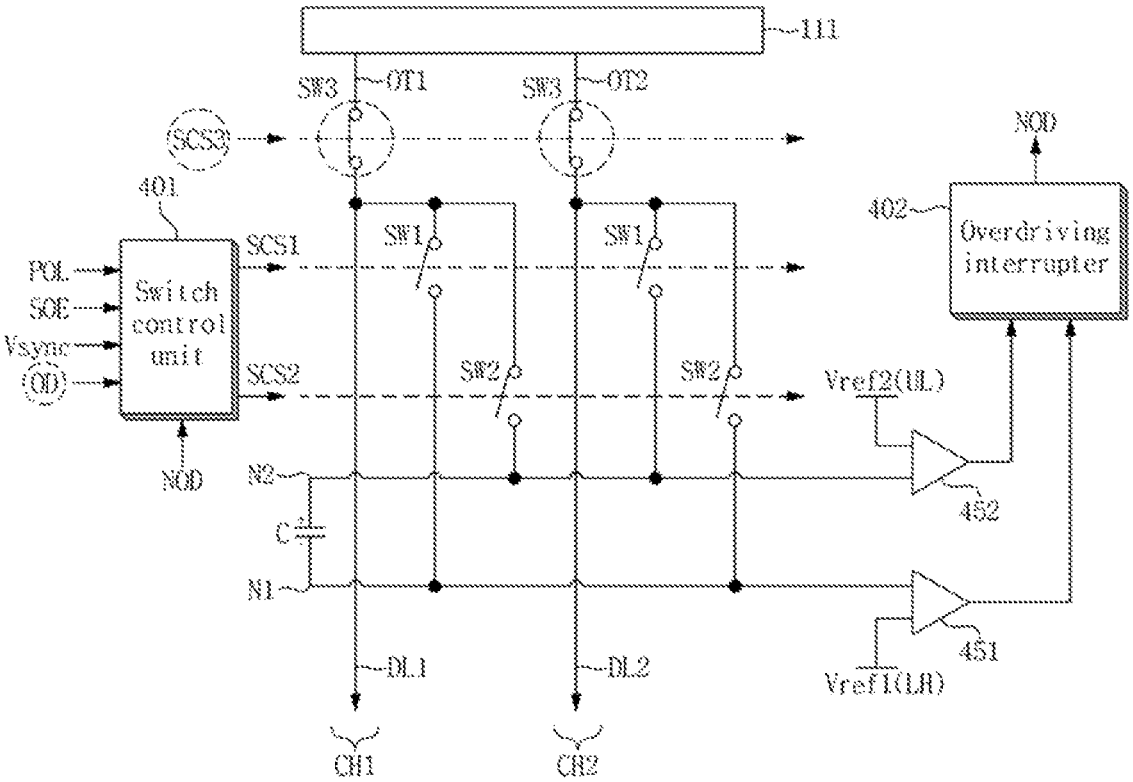

FIGS. 7A and 7B are diagrams respectively illustrating driving of first, second and third switches included in each of two adjacent channels during overdriving. In FIGS. 7A and 7B, a signal surrounded by a circular dashed line denotes a signal having the active level and a switch surrounded by a circular dashed line denotes a turned-on switch.

FIG. 8A, briefly mentioned earlier, is a signal and timing diagram illustrating voltage variation of the first data line due to the overdriving in FIGS. 7A and 7B, and FIG. 8B is a signal and timing diagram illustrating voltage variation of the second data line due to the overdriving in FIGS. 7A and 7B.

The label "Data1" in FIG. 8A denotes image data signals (digital signals) as a function of time, corresponding to the first data line DL1. The label "Vdata1" in FIG. 8 denotes a data voltage (an analog signal, i.e., a gray level voltage) corresponding to the data signal Data1, which represents a voltage of the first data line DL1. The voltage Vdata1 as a function of time is referred to as a first previous data voltage VP_n−1 during the time period and a first current data voltage VP_n during the time period ③.

The label "Data2" in FIG. 8B denotes image data signals (digital signals) as a function of time, corresponding to the second data line DL2. The label "Vdata2" in FIG. 8B denotes a data voltage (an analog signal, i.e., a gray level voltage) corresponding to the data signal Data2, which represents a voltage of the second data line DL2. The voltage Vdata2 has a temporal portion referred to as a second previous data voltage VN_n−1 and a temporal portion referred to as a second current data voltage VN_n.

Prior to describing the operations related to FIGS. 7A and 7B, the operation of a previous source output period will first be described.

The source output enable signal SOE defines a source output period and a horizontal blanking period. A period (for example, ① or ③) during which the source output enable signal SOE maintains a low level corresponds to the aforementioned source output period, and a period (for example, ②) during which the source output enable signal maintains a high level corresponds to the aforementioned horizontal blanking period.

The data driver 111 substantially simultaneously outputs data voltages of the first horizontal line during the source output period of the source output enable signal SOE. For example, the data driver 111 substantially simultaneously outputs the data voltages of the first horizontal line during the first source output period of the source output enable signal SOE. Thereafter, the data driver 111 substantially simultaneously outputs data voltages of the second horizontal line during the second source output period ① after the horizontal blanking period ②.

Here, the first source output period ① is defined as a previous source output period and the second source output period ③ is defined as a current source output period. Further, the data voltage of the first horizontal line is defined as a previous data voltage and the data voltage of the second horizontal line is defined as a current data voltage. In addition, a digital image data signal corresponding to the data voltage of the first horizontal line is defined as a previous image data signal and a digital image data signal corresponding to the data voltage of the second horizontal line is defined as a current image data signal.

During the previous source output period ①, all of the data lines DL1 to DLj including the first and second data lines DL1 and DL2 receive previous data voltages output from the data driver 111 during the previous source output period ①. For example, the first data line DL1 receives a first previous data voltage and the second data line DL2 receives a second previous data voltage.

A data voltage corresponding to the odd-numbered data lines DL1, DL3, . . . , DLj−1 and a data voltage corresponding to the even-numbered data lines DL2, DL4, . . . , DLj have mutually opposite polarities. For example, in the case where the data voltage (the previous data voltage or the current data voltage) corresponding to the first data line DL1 has a positive polarity, the voltage corresponding to the second data line DL2 (the previous data voltage or the current data voltage) has a negative polarity.

The polarity of the data voltage is determined by the polarity control signal POL. The polarity control signal POL has two different levels and its level may be changed in units of one frame period. For example, when the polarity control signal POL has a first level, the data voltage corresponding to the odd-numbered data lines DL1, DL3, . . . , DLj−1 has a positive polarity, while the data voltage corresponding to the even-numbered data lines DL2, DL4, . . . , DLj has a negative polarity. On the other hand, when the polarity control signal POL has a second level, the data voltage corresponding to the odd-numbered data lines DL1, DL3, . . . , DLj−1 has a negative polarity, while the data voltage corresponding to the even-numbered data lines DL2, DL4, . . . , DLj has a positive polarity.

The timing controller 101 may determine whether to perform overdriving based on the previous image data signals and the current image data signals at a falling edge timing of a preceding pulse among adjacent pulses defining the previous source output period ①. Then, the timing controller 101 outputs the overdriving control signal OD at a rising edge timing of a temporally lagging pulse among the adjacent pulses. That is, an overdriving control signal OD of the inactive level or an overdriving control signal OD of the active level may be output at the rising edge timing. Here, it is assumed that the image data signals satisfy the conditions described above with reference to FIG. 6 and the timing controller 101 determines to perform overdriving.

In such an exemplary embodiment, in the horizontal blanking period ②, the switches SW1, SW2 and SW3 operate under the control of signals SCS1, SCS2 and SCS3, respectively, as illustrated in FIG. 8A. Hereinafter, the operation of the display device in the horizontal blanking period ② will be described in detail with reference to FIG. 8A.

First, as described above, the first previous data voltage VP_n−1 of the positive polarity is applied to the first data line DL1 in the previous source output period ① and the second previous data voltage VN_n−1 of the negative polarity is applied to the second data line DL2 (as seen in FIG. 8B).

Subsequently, in the horizontal blanking period ② as illustrated in FIG. 8A, the overdriving control signal OD of the active level is output from the timing controller 101. The overdriving control signal OD is output at this time due to the large anticipated voltage difference between the previous data voltage corresponding to FFh (255) and the current data voltage corresponding to 00h (0).

The switch controller 401 selects the first switches SW1 or the second switches SW2 based on the level of the polarity control signal POL input thereto and turns on the selected switches. For example, when the polarity control signal POL has a first level, the switch controller 401 turns on all of the first switches SW1 and turns off all of the second switches SW2. This is apparent in FIG. 8A as control signal SCS1 is pulsed to an active level AL during the horizontal blanking period ② while the control signal SCS2 remains at an inactive level "IL" during this time. In an exemplary embodiment, in the horizontal blanking period ②, the timing controller 101 turns off all of the third switches SW3. (Control signal ACS3 has an inactive level IL during this time.)

To this end, the switch controller 401 applies the first switch control signal SCS1 of the active level to each gate electrode (in the case of switches SW1, SW2, SW3 embodied as FETs) of the first switches SW1 and applies the second switch control signal SCS2 of the inactive level to each gate electrode of the second switches SW2. In addition, the timing controller 101 applies the third switch control signal SCS3 of the inactive level to each gate electrode of the third switches SW3.

The first switch control signal SCS1 of the active level maintains the active level during a period in which the overdriving control signal OD of the active level and a pulse defining the horizontal blanking period ② of the source output enable signal SOE overlap each other.

The third switch control signal SCS3 has the active level for every horizontal blanking period ② of the source output enable signal SOE and has the inactive level for every source output period of the source output enable signal SOE.

Accordingly, during the horizontal blanking period ②, the first switches SW1 are all turned on, the second switches SW2 are all turned off and the third switches SW3 are all turned off in FIG. 8A.

Then, for example, the first data line DL1 and the one terminal N1 of the capacitor C are connected to each other during the horizontal blanking period ② by the first switch SW1 of the first channel CH1 that is turned on. Accordingly, a voltage of\terminal N1 of the capacitor C, that is, a negative polarity overdriving voltage QL, is applied to the first data line DL1. Accordingly, the voltage VP_n−1 of the first data line DL1 may be rapidly reduced during the time of the horizontal blanking period ② and shortly thereafter as seen in FIG. 8A.

At substantially the same time, the second data line DL2 and terminal N2 of the capacitor C are connected to each other by the first switch SW1 of the second channel CH2 that is turned on, as understood by the control signals in FIG. 8B. Accordingly, a voltage of terminal N2 of the capacitor C, that is, a positive polarity overdriving voltage QH, is applied to the second data line DL2. Accordingly, the voltage VN_n−1 of the second data line DL2 may rapidly increase during the time of the horizontal blanking period ② and shortly thereafter as seen in FIG. 8B.

Hereinafter, the operation of the display device in the current source output period will be further described in detail with reference to FIG. 8B.

During the current source output period ③, as illustrated in FIG. 8B, the data driver 111 outputs data voltages of the current horizontal line including the first current data voltage VP_n and the second current data voltage VN_n. The first current data voltage VP_n is output through the first output terminal OT1 of the data driver 111 and the second current data voltage VN_n is output through the second output terminal OT2. The first current data voltage VP_n has a positive polarity and the second current data voltage VN_n has a negative polarity.

During the current source output period ③, the switch controller 401 turns off all of the first switches SW1 and the second switches SW2. In addition, the timing controller 101 turns on all of the third switches SW3.

To this end, the switch controller 401 applies the first switch control signal SCS1 of the inactive level to each gate electrode of the first switches SW1 and the second switch control signal SCS2 of the inactive level to each gate electrode of the second switches SW2. In addition, the timing controller 101 applies the third switch control signal SCS3 of the active level to each gate electrode of the third switches SW3.

In such an exemplary embodiment, for example, the first output terminal OT1 and the first data line DL1 are connected to each other by the third switch SW3 of the first channel CH1 that is turned on, and the second output terminal OT2 and the second data line DL2 are connected to each other by the third switch SW3 of the second channel CH2 that is turned on. Accordingly, the first current data voltage VP_n from the data driver 111 is applied to the first data line DL1 and the second current data voltage VN_n from the data driver 111 is applied to the second data line DL2.

Since the voltage of the first data line DL1 is sufficiently reduced by the negative polarity overdriving voltage QL during the aforementioned horizontal blanking period ②, the first current data voltage may sufficiently reach a target voltage during the current source output period ③. For example, in the case where the first previous data voltage VP_n−1 of the positive polarity is the maximum positive polarity gray level voltage UH corresponding to a full white image data signal FFh and the first current data voltage VP_n is a minimum positive polarity gray level voltage UL corresponding to a full black image data signal ooh, the voltage of the first data line DL1 may reach the level of the minimum positive polarity gray level voltage UL during the current source output period ③.

In addition, since the voltage of the second data line DL2 is sufficiently raised by the positive polarity overdriving voltage QH in the above-described horizontal blanking period ②, the second current data voltage VN_n may sufficiently reach a target voltage during the current source output period ③. For example, in the case where the second previous data voltage VN_n−1 of the negative polarity is the maximum negative polarity gray level voltage LL corresponding to the full white image data signal FFh and the second current data voltage VN_n is the minimum negative polarity gray level voltage LH corresponding to the full black image data signal 00h, the voltage of the second data line DL2 may reach the level of the minimum negative polarity gray level voltage LH during the current source output period ③.

In an exemplary embodiment, during the normal driving, not the overdriving, the switch controller 401 turns off all of the first switches SW1 and the second switches SW2 during the above-described horizontal blanking period ②, and the timing controller 101 turns on all of the third switches SW3 during the above-described horizontal blanking period ②. This is illustrated in FIG. 8A in the time period prior to that of VP_n−1. A prior data voltage has a peak value 81 corresponding to a digital data value significantly below the maximum FFh; and this prior data voltage is followed by a data voltage at a level 83 which is above the minimum voltage corresponding to ooh. Thus, the difference between adjacent data is relatively small, such that overdriving is unnecessary, and a normal driving is applied. A similar scenario is apparent in FIG. 8B, as illustrated by the voltage levels 82, 84 of temporally adjacent data.

Figure 9A:
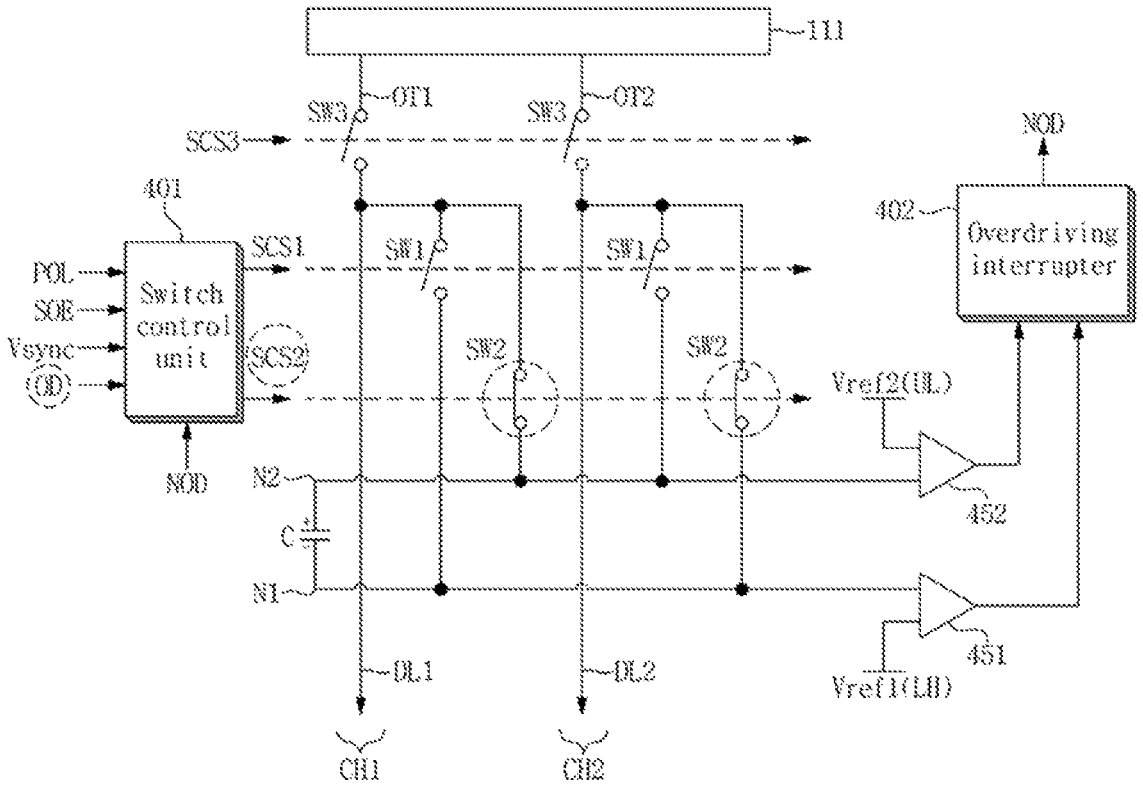
FIGS. 9A and 9B are each a diagram illustrating driving of the display device according to an exemplary embodiment in a vertical blanking period of a vertical synchronization signal.
Figure 9B:
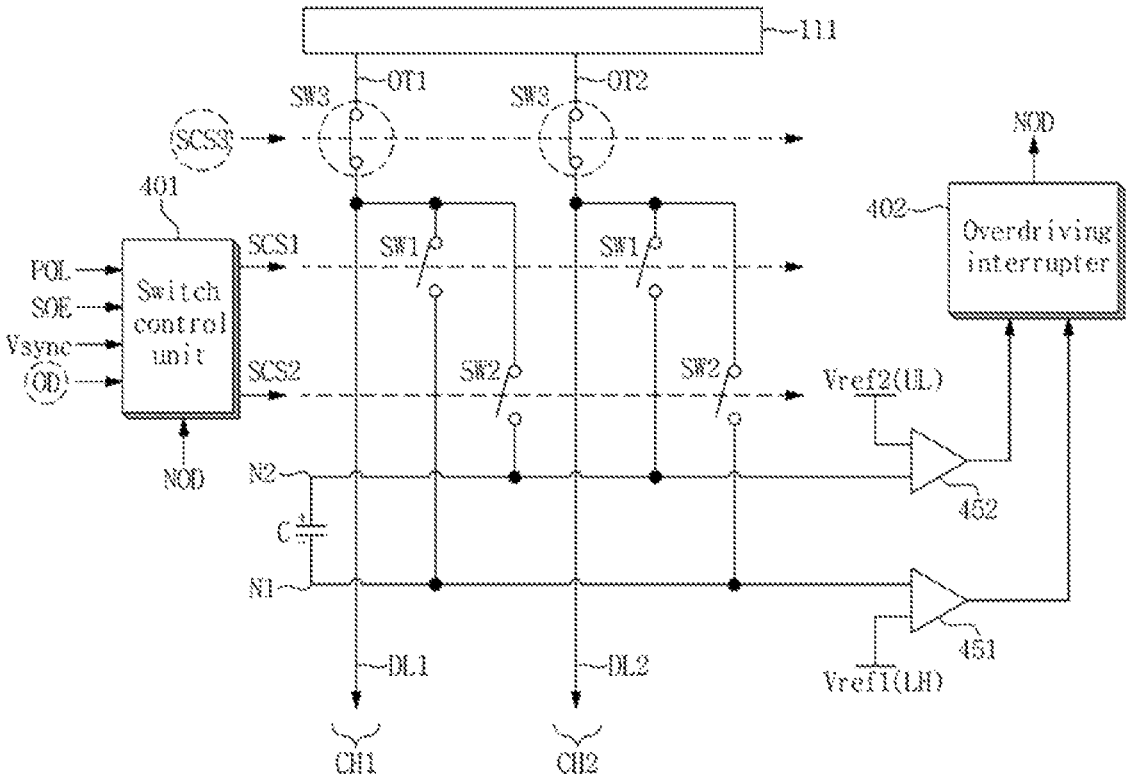

FIGS. 9A and 9B are diagrams illustrating driving of the display device according to an exemplary embodiment in a vertical blanking period of the vertical synchronization signal.

The vertical synchronization signal Vsync defines the vertical blanking period. The vertical blanking period is positioned between adjacent frame periods.

During a first half of the vertical blanking period, as illustrated in FIG. 9A, the switching controller 401 selects the first switches SW1 or the second switches SW2 based on the level of the polarity control signal POL and turns on the selected switches. For example, when the polarity control signal POL has a first level, the switch controller 401 turns on all of the second switches SW2 and turns off all of the first switches SW1. In an exemplary embodiment, during the first half of the vertical blanking period, the timing controller 101 turns off all of the third switches SW3.

To this end, the switch controller 401 applies the first switch control signal SCS1 of the inactive level to each gate electrode of the first switches SW1 and applies the second switch control signal SCS2 of the active level to each gate electrode of the second switches SW2. In addition, the timing controller 101 applies the third switch control signal SCS3 of the inactive level to each gate electrode of the third switches SW3.

Accordingly, during the first half of the vertical blanking period, the second switches SW2 are all turned on, the first switches SW1 are all turned off and the third switches SW3 are all turned off.

In such an exemplary embodiment, the first data line DL1 and terminal N2 of the capacitor C are connected to each other by the second switch SW2 of the first channel CH1 that is turned on. Accordingly, the voltage of the first data line DL1 is applied to terminal N2 of the capacitor C. As illustrated in FIG. 8B described above, when the first current data voltage VP_n of the positive polarity is applied to the first data line DL1, the one terminal N1 of the capacitor C maintains the positive polarity voltage.

At a time, the second data line DL2 and the one terminal N1 of the capacitor C are connected to each other by the second switch SW2 of the second channel CH2 that is turned on. Accordingly, the voltage of the second data line DL2 is applied to the one terminal N1 of the capacitor C. As illustrated in FIG. 8B described above, when the second current data voltage VN_n having the negative polarity is applied to the second data line DL2, the one terminal N1 of the capacitor C maintains the negative polarity voltage.

As such, during the first half of the vertical blanking period, the capacitor C is charged by the voltage of the data lines DL1 to DLj. That is, during the first half of the vertical blanking period, the odd-numbered data lines DL1, DL3, . . . , DLj−1 are connected in common to terminal N2 of the capacitor C and the even-numbered data lines DL2, DL4, . . . , DLj are connected in common to the one terminal N1 of the capacitor C, and accordingly, terminal N2 of the capacitor C is charged with positive polarity voltages from the odd-numbered data lines DL1, DL3, . . . , DLj−1 and the one terminal N1 of the capacitor C is charged with negative polarity voltages from the even-numbered data lines DL2, DL4, . . . , DLj.

Accordingly, the capacitor C may be periodically charged every first half of the vertical blanking period.

During a second half of the vertical blanking period, as illustrated in FIG. 9B, the switch controller 401 turns off all of the first switches SW1 and the second switches SW2. In addition, the timing controller 101 turns on all of the third switches SW3.

To this end, the switch controller 401 applies the first switch control signal SCS1 of the inactive level to each gate electrode of the first switches SW1 and the second switch control signal SCS2 of the inactive level to each gate electrode of the second switches SW2. In addition, the timing controller 101 applies the third switch control signal SCS3 of the active level to each gate electrode of the third switches SW3.

Accordingly, during the second half of the vertical blanking period, the first switches SW1 and the second switches SW2 are all turned off and the third switches SW3 are all turned on.

In such an exemplary embodiment, for example, the first output terminal OT1 and the first data line DL1 are connected to each other by the third switch SW3 of the first channel CH1 that is turned on, and the second output terminal OT2 and the second data line DL2 are connected to each other by the third switch SW3 of the second channel CH2 that is turned on.

In an exemplary embodiment, during the second half of the vertical blanking period, the data driver 111 outputs an initialization voltage through each of the output terminals OT1 to OTj. In such an exemplary embodiment, the initialization voltage is applied to each of the data lines DL1 to DLj through respective ones of the output terminals OT1 to OTj. Accordingly, during the second half of the vertical blanking period, the data lines DL1 to DLj may be initialized to the initialization voltage. This initialization voltage may be the aforementioned half reference voltage HAVDD.

Figure 10:
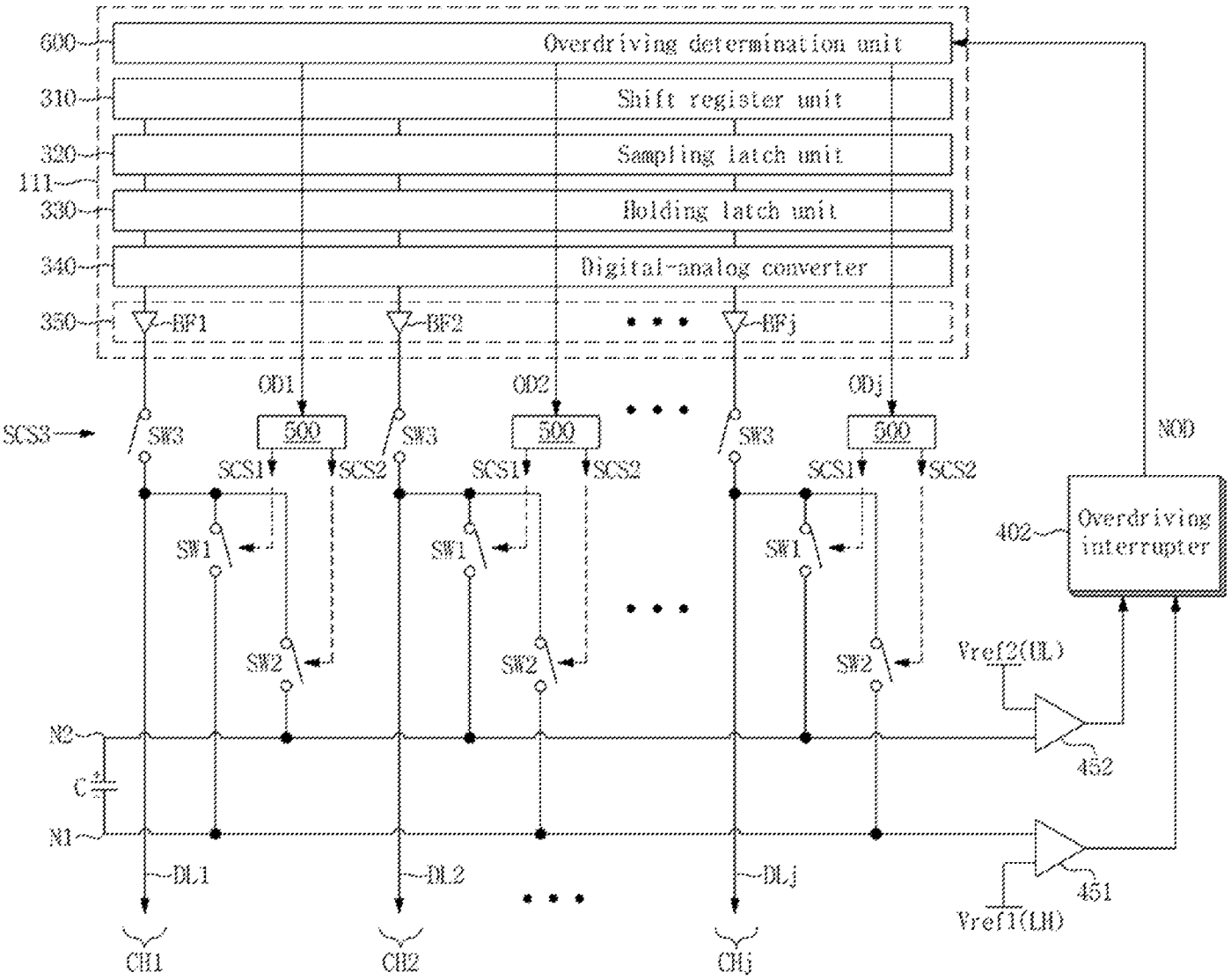
FIG. 10 is a schematic block diagram illustrating an example data driver of FIG. 3 and alternative components for overdriving.

FIG. 10 is a schematic diagram illustrating the data driver of FIG. 3 and alternative components for overdriving, according to an alternative exemplary embodiment. In this embodiment, an overdriving determination is made independently for each channel, rather than for an entire horizontal row as in the case of FIG. 4.

As illustrated in FIG. 10, the display device according to an alternative exemplary embodiment may further include a capacitor C, a plurality of switches SW1, SW2 and SW3, an overdriving determination unit (circuit) 600, a plurality of switch controllers 500, an overdriving interrupter 402, a first comparator 451 and a second comparator 452.

The overdriving determination unit 600 outputs a plurality of overdriving control signals OD1 to ODj based on previous image data signals stored in a holding latch unit 330 and current image data signals stored in a sampling latch unit 320. In other words, the overdriving determination unit 600 compares respective corresponding ones of the plurality of previous image data signals and the plurality of current image data signals, and selects a level of each of the overdriving control signals OD1 to ODj based on the comparison result. Accordingly, the overdriving control signals OD1 to ODj may each have different levels. For example, a first overdriving control signal OD1 corresponding to a first channel CH1 may have the active level, while a second overdriving control signal OD2 corresponding to a second channel CH2 may have the inactive level.

The overdriving determination unit 600 may be embedded in a data driver 111. In such an exemplary embodiment, the data driver 111 may generate an overdriving control signal by itself.

In an exemplary embodiment, in the case where the display device according to an exemplary embodiment has the configuration as illustrated in FIG. 10, the timing controller 101 of the display device does not generate the overdriving control signal OD. In other words, in the display device having the configuration illustrated in FIG. 10, the data driver 111 itself may determine whether to perform overdriving operation without the help of the timing controller 101.

The respective switch controllers 500 receive the overdriving control signals OD1 to ODj from the overdriving determination unit 600. The operation of each switch controller 500 is substantially the same as that of the switch controller 401 of FIG. 4. However, the switch controller 500 is provided for each channel.

Each switch controller 500 controls a first switch SW1 and a second switch SW2 of the corresponding channel. For example, a switch controller 500 of the first channel CH1 controls each of a first switch SW1 of the first channel CH1 and a second switch SW2 of the first channel CH1, and a switch controller 500 of the second channel CH2 controls each of a first switch SW1 of the second channel CH2 and a second switch SW2 of the second channel CH2.

Each switch controller 500 receives the polarity control signal POL, the source output enable signal SOE and the vertical synchronization signal Vsync described above.

In an exemplary embodiment, a third switch SW3 of each channel is controlled in common according to a third switch control signal SCS3 of a timing controller 101 as described above.

An overdriving interruption signal NOD output from the overdriving interrupter 402 of FIG. 10 is applied to the overdriving determination unit 600. When the overdriving interruption signal NOD of the active level from the overdriving interrupter 402 is applied to the overdriving determination unit 600, the overdriving determination unit 600 applies overdriving signals OD1 to ODj of the inactive level to all of the switch controllers 500.

Figure 11:
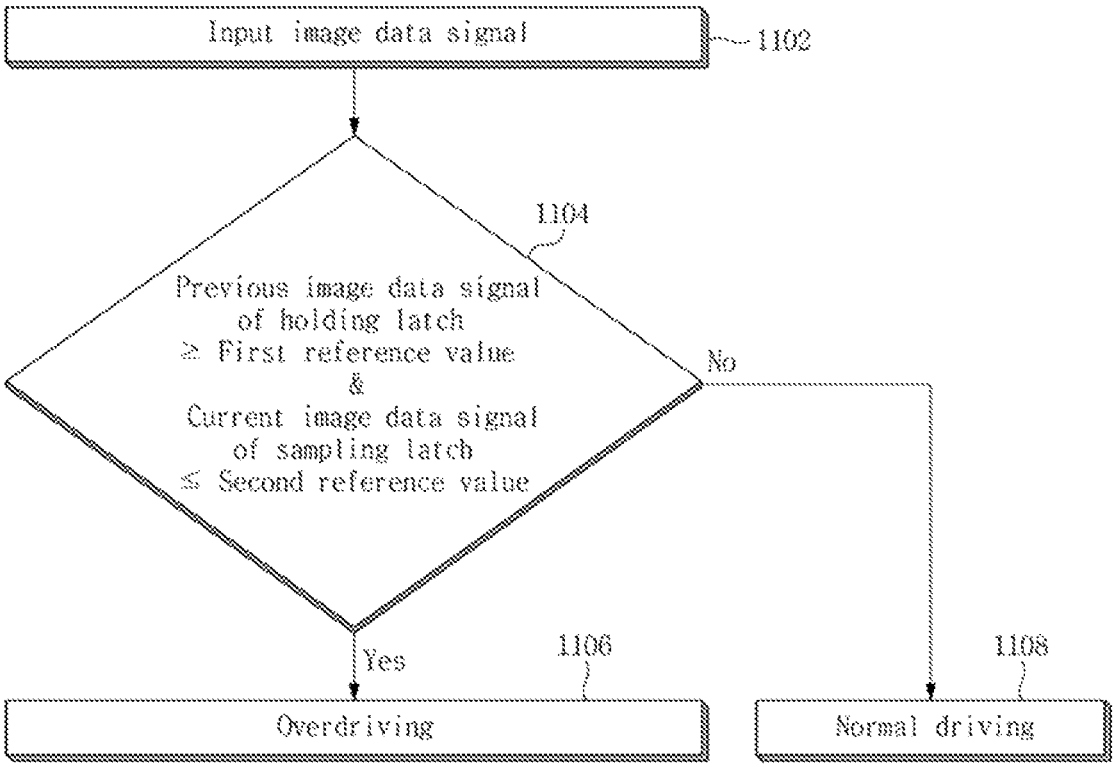
FIG. 11 is a flowchart illustrating a method of how an overdriving determination unit of FIG. 10 determines whether to perform overdriving.

FIG. 11 is a flowchart illustrating an example method of how the overdriving determination unit of FIG. 10 determines whether to perform overdriving.

Input image data signals are received (1102) by the data driver 111. The overdriving determination unit 600 outputs the overdriving control signals OD1 to ODj based on image data signals stored in the data driver 111. In other words, the overdriving determination unit 600 outputs the overdriving control signals OD1 to ODj based on the image data signals stored in the sampling latch unit 320 and the holding latch unit 330 of the data driver 111. For example, the overdriving determination unit 600 compares (1104) a previous image data signal stored in one holding latch among the image data signals with a first reference value and compares a current image data signal stored in a sampling latch corresponding thereto with a second reference value, respectively.

When the previous image data signal of the holding latch is greater than or equal to the first reference value and the current image data signal of the sampling latch is less than or equal to the second reference value, the overdriving determination unit 600 outputs an overdriving control signal of the active level (1106). On the other hand, when the above condition is not satisfied, the overdriving determination unit 600 outputs an overdriving control signal of the inactive level (1108) so that normal driving is performed.

The switch controller 500 that receives the overdriving control signal of the active level from the overdriving determination unit 600 selects one of the first switch SW1 and the second switch SW2 of the corresponding channel in a horizontal blanking period, and turns on the selected one of the first switch SW1 and the second switch SW2. In such an exemplary embodiment, the switch controller 500 selects one switch based on the level of the polarity control signal POL in the current frame period including the horizontal blanking period as described above.

In an exemplary embodiment, the switch controller 500 that receives the overdriving control signal of the inactive level from the overdriving determination unit 600 turns off the first switch SW1 and the second switch SW2 of the corresponding channel in the horizontal blanking period.

Figure 12:
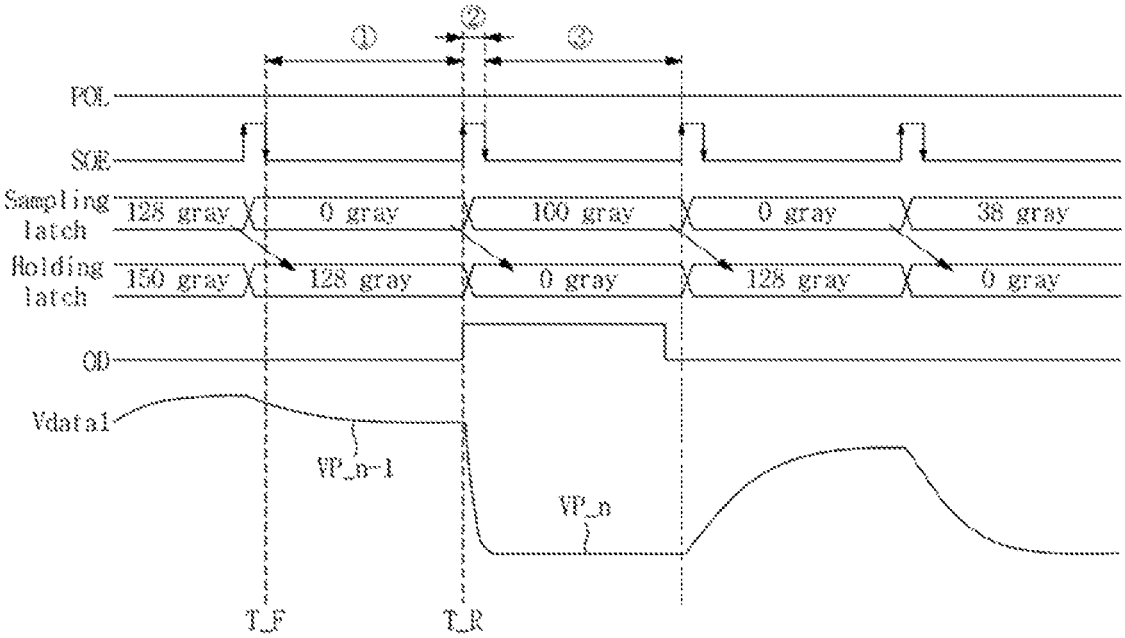
FIG. 12 is a diagram illustrating a time point for image comparison of the overdriving determination unit and an output time point of an overdriving control signal having an active level of FIG. 10.

FIG. 12 is a diagram illustrating a time point for image comparison of the overdriving determination unit and an output time point of the overdriving control signal having the active level of FIG. 10. An arrow illustrated in FIG. 12 means that a digital image data signal of the sampling latch is output to the holding latch. The holding latch receives the digital image data signal from the sampling latch in accordance with a rising edge timing of the source output enable signal SOE and outputs a data voltage corresponding thereto. In an exemplary embodiment, the polarity control signal in FIG. 12 has a first level.

The overdriving determination unit 600 compares the previous image data signal of the holding latch with the first reference value at a falling edge timing of the source output enable signal SOE, and compares the current image data signal of the sampling latch with the second reference value at the falling edge timing. Then, based on the comparison result, the over driving determination unit 600 determines whether to perform overdriving.

For example, as illustrated in FIG. 12, at a falling edge timing T_F of a preceding pulse among adjacent pulses defining a previous source output period ①, the overdriving determination unit 600 determines whether to perform overdriving based on the previous image data signal (a gray level 128, i.e., a digital image data signal corresponding to a gray level of 128) of the holding latch and the current image data signal (a gray level 0, i.e., a digital image data signal corresponding to a gray level of 0) of the sampling latch.

Then, the overdriving determination unit 600 outputs the overdriving control signal OD at a rising edge timing T_R of a temporally lagging pulse among the adjacent pulses. That is, an overdriving control signal OD of the inactive level or an overdriving control signal OD of the active level may be output at the rising edge timing T_R.

FIG. 12 shows an example in which an overdriving control signal OD having the active level is output from the rising edge timing T_R. The overdriving control signal OD maintains the active level until a rising edge timing of a succeeding pulse. In other words, the overdriving control signal OD maintains the active level within a current source output period ③. Due to the overdriving control signal of the active level, a voltage VPn−1 (a first previous data voltage having a gray level of 128) of the first data line DL1 sharply drops in the horizontal blanking period ②. Accordingly, the voltage VPn−1 (the first previous data voltage having a gray level of 128) of the first data line DL1 may reach a target voltage VP_n (a first current data voltage having a gray level of 0) during the current source output period ③.

Figure 13:
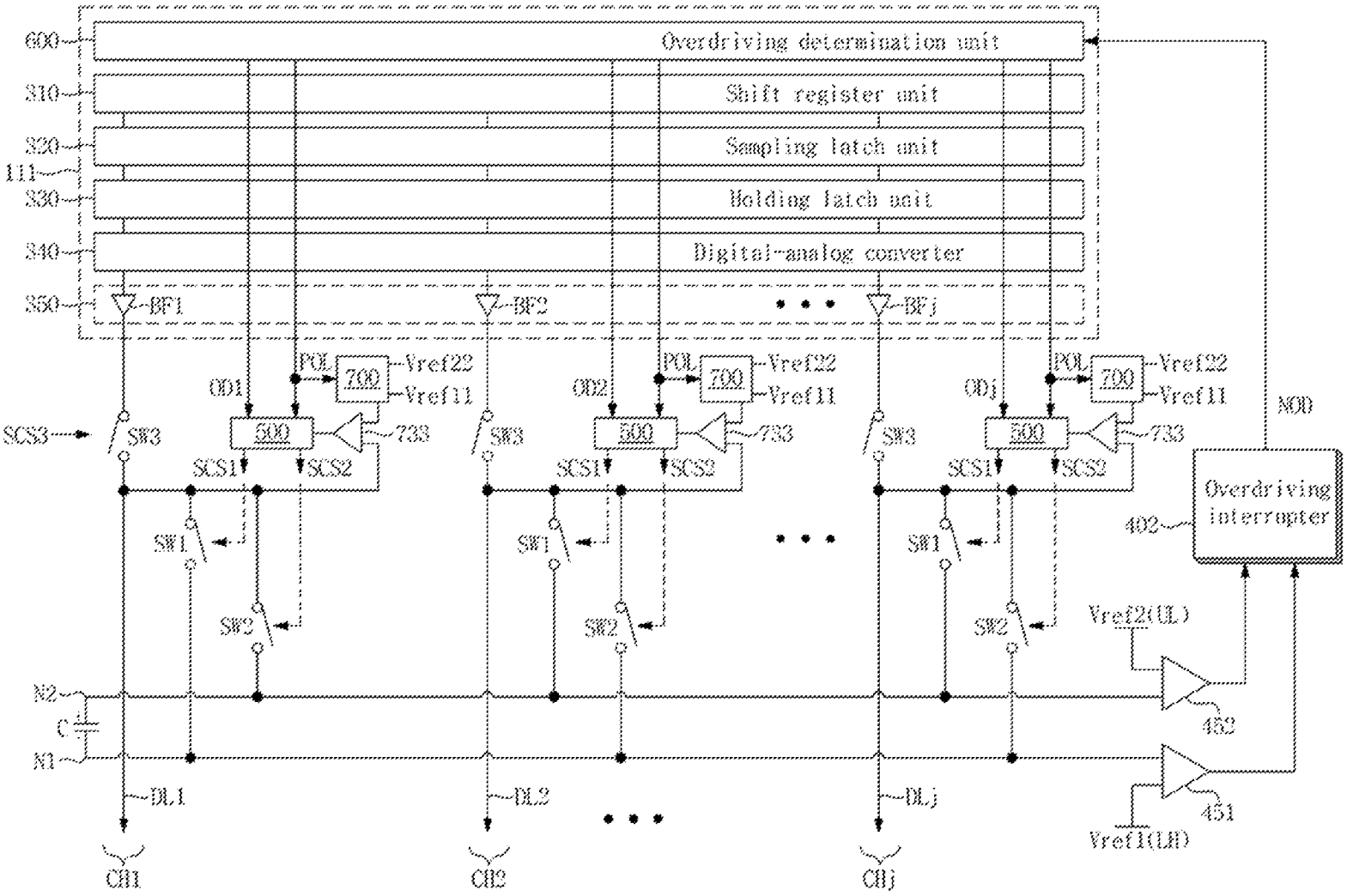
FIG. 13 a view illustrating the data driver of FIG. 3 and other alternative components for overdriving.

FIG. 13 a schematic block diagram illustrating an example of the data driver of FIG. 3 and other alternative components for overdriving.

As illustrated in FIG. 13, the display device according to another alternative exemplary embodiment may further include a capacitor C, a plurality of switches SW1, SW2 and SW3, an overdriving determination unit 600, a plurality of switch controllers 500, an overdriving interrupter 402, a first comparator 451, a second comparator 452, a plurality of selection units 700 and a plurality of comparators 733.

The selection unit 700 of a first channel CH1 selects one of a first reference voltage Vref11 and a second reference voltage Vref22 based on a level of a polarity control signal POL. For example, when the polarity control signal POL has a first level, the selection unit 700 of the first channel CH1 may select the first reference voltage Vref11, and when the polarity control signal POL has a second level, the selection unit 700 of the first channel CH1 may select the second reference voltage Vref22.

The second reference voltage Vref22 may be higher than the first reference voltage Vref11. For example, the first reference voltage Vref11 may have a substantially same value as that of a minimum negative polarity gray level voltage LH and the second reference voltage Vref22 may have a substantially same value as that of a minimum positive polarity gray level voltage UL.

The comparator 733 of the first channel CH1 compares the reference voltage selected by the selection unit 700 of the first channel CH1 with a voltage of a first data line DL1 and outputs a comparison signal based on the comparison result. The comparison signal output from the comparator 733 of the first channel CH1 is applied to the switch controller 500 of the first channel CH1.

In the case where the first reference voltage Vref11 is applied to the comparator 733 of the first channel CH1, when the voltage of the first data line DL1 is less than or equal to the first reference voltage Vref11, the comparator 733 of the first channel CH1 outputs the comparison signal of the active level. In the case where the second reference voltage Vref22 is applied to the comparator 733 of the first channel CH1, when the voltage of the first data line DL1 is greater than or equal to the second reference voltage Vref22, the comparator 733 of the first channel CH1 outputs the comparison signal of the active level.

The switch controller 500 of the first channel CH1 that receives the comparison signal of the active level from the comparator 733 of the first channel CH1 turns off the first switch SW1 of the first channel CH1 and the second switch SW2 of the first channel CH1. To this end, the switch controller 500 of the first channel CH1 outputs a first switch control signal SCS1 of the inactive level and a second switch control signal SCS2 of the inactive level.

The selection unit 700 of the first channel CH1 and the comparator 733 of the first channel CH1 stops the overdriving operation of the switch controller 500 of the first channel when the voltage of the first data line DL1 reaches the first reference voltage Vref11 (the minimum negative polarity gray level voltage) or the second reference voltage Vref22 (the minimum positive polarity gray level voltage) due to the overdriving operation. That is, depending on the resistance magnitude of the first switch SW1 and the second switch SW2, the overdriving voltage higher than or lower than intended may be applied to the first data line DL1, and the selection unit 700 of the first channel CH1 and the comparator 733 of the first channel CH1 may substantially minimize the variation of the overdriving voltage due to the resistance variation of the switch.

In an exemplary embodiment, the selection unit 700 of a second channel CH2 selects one of the first reference voltage Vref11 and the second reference voltage Vref22 based on the level of the polarity control signal POL. However, the selection unit 700 of the second channel CH2 selects a different reference voltage from what the aforementioned selection unit 700 of the first channel CH1 selects. For example, in the case where the polarity control signal POL has a first level, the selection unit 700 of the second channel CH2 may select the second reference voltage Vref22, and in the case where the polarity control signal POL has a second level, the selection unit 700 of the second channel CH2 may select the first reference voltage Vref11.

The comparator 733 of the second channel CH2 compares the reference voltage selected by the selection unit 700 of the second channel CH2 with a voltage of a second data line DL2 and outputs a comparison signal based on the comparison result. The comparison signal output from the comparator 733 of the second channel CH2 is applied to the switch controller 500 of the second channel CH2.

In the case where the first reference voltage Vref11 is applied to the comparator 733 of the second channel CH2, when the voltage of the second data line DL2 is less than or equal to the first reference voltage Vref11, the comparator 733 of the second channel CH2 outputs the comparison signal of the active level. In the case where the second reference voltage Vref22 is applied to the comparator 733 of the second channel CH2, when the voltage of the second data line DL2 is greater than or equal to the second reference voltage Vref22, the comparator 733 of the second channel CH2 outputs the comparison signal of the active level.

The switch controller 500 of the second channel CH2 that receives the comparison signal of the active level from the comparator 733 of the second channel CH2 turns off the first switch SW1 of the second channel CH2 and the second switch SW2 of the second channel CH2. To this end, the switch controller 500 of the second channel CH2 outputs the first switch control signal SCS1 of the inactive level and the second switch control signal SCS2 of the inactive level.

The selection unit 700 of the second channel CH2 and the comparator 733 of the second channel CH2 stops the overdriving operation of the switch controller 500 of the second channel CH2 when the voltage of the second data line DL2 reaches the first reference voltage Vref11 (the minimum negative polarity gray level voltage) or the second reference voltage Vref22 (the minimum positive polarity gray level voltage) due to the overdriving operation.

The selection unit 700 and the comparator 733 of odd-numbered channels operate in a substantially manner as in the selection unit 700 and the comparator 733 of the first channel CH1 described above, and the selection unit 700 and the comparator 733 of even-numbered channels operate in a substantially manner as in the selection unit 700 and the comparator 733 of the second channel CH2 described above.

In an exemplary embodiment, the operations of the selection unit 700 and the comparator 733 of each channel described above are performed in the horizontal blanking period described above. For example, when one of the first and second switch control signals SCS1 and SCS2 has the active level and the third switch control signal SCS has the inactive level, each selection unit selects one reference voltage Vref11 or Vref22 based on the level of the polarity control signal in the previous source output period including the horizontal blanking period. Further, when one of the first and second switch control signals SCS1 and SCS2 has the active level and the third switch control signal SCS3 has the inactive level, the comparator outputs the comparison signal based on the comparison between the selected reference voltage and the voltage of the data line.

Figure 14:
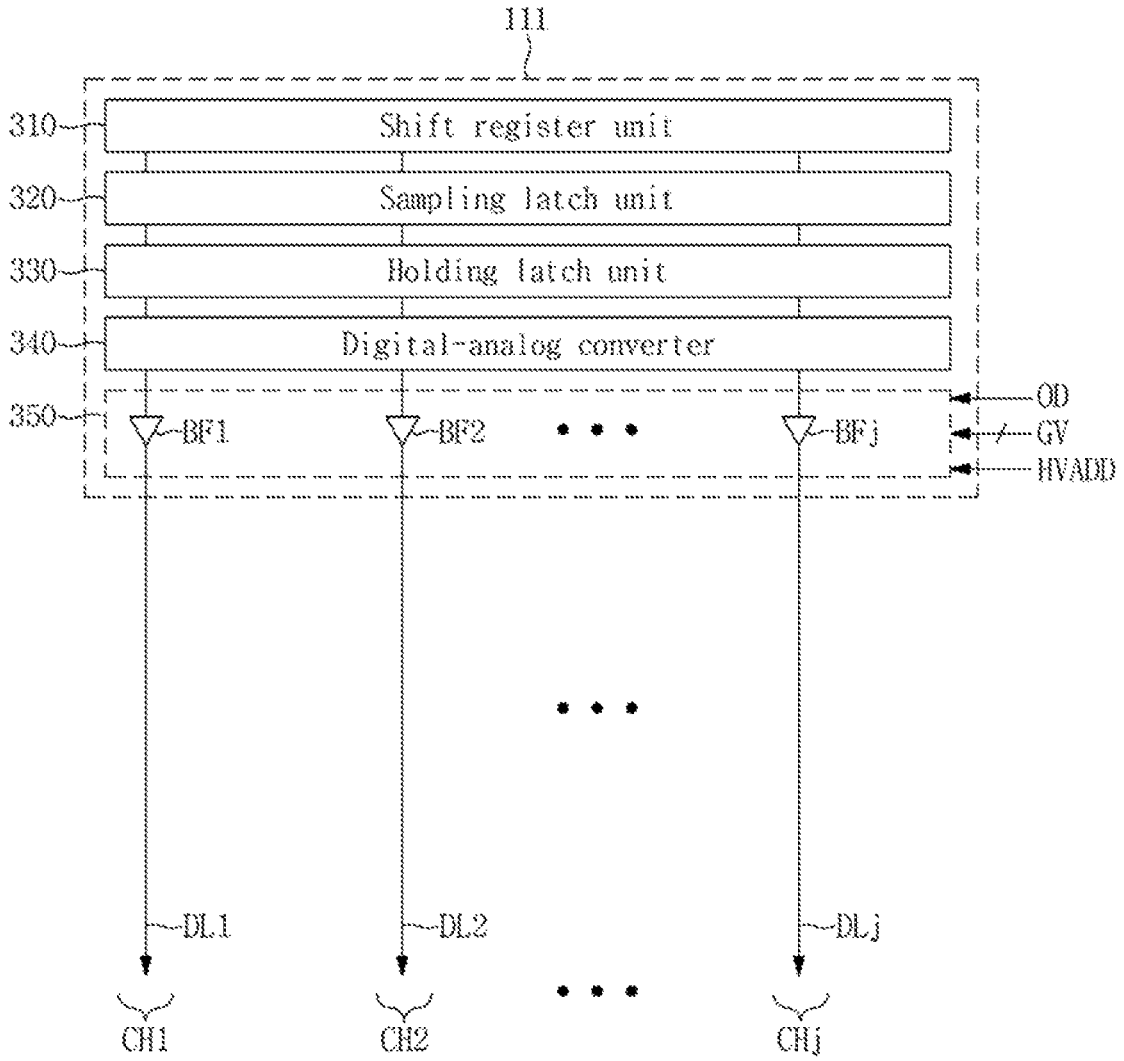
FIG. 14 a view illustrating still other alternative components for overdriving of the display device illustrated in FIG. 3.

FIG. 14 a view illustrating still other alternative components for overdriving of the display device illustrated in FIG. 3.

As illustrated in FIG. 14, a buffer unit 350 may receive an overdriving control signal OD. The overdriving control signal OD may be provided from the aforementioned timing controller 101 or the aforementioned overdriving determination unit 600.

The buffer unit 350 receiving the overdriving control signal OD of the active level from the timing controller 101 outputs a half reference voltage HVADD during a horizontal blanking period ②. The half reference voltage HVADD is applied to all of data lines DL1 to DLj during the horizontal blanking period ②.

In the case where the overdriving control signal OD is applied from the timing controller 101, the entirety of buffers BF1 to BFj perform the overdriving operation at a substantially same time or do not perform the overdriving operation. On the other hand, in the case where a plurality of overdriving control signals OD1 to ODj having different levels from each other are provided from the overdriving determination unit 600, each of the buffers BF1 to BFj individually perform the overdriving operation or do not perform the overdriving operation based on the level of each corresponding overdriving control signal applied thereto.

Figure 15:
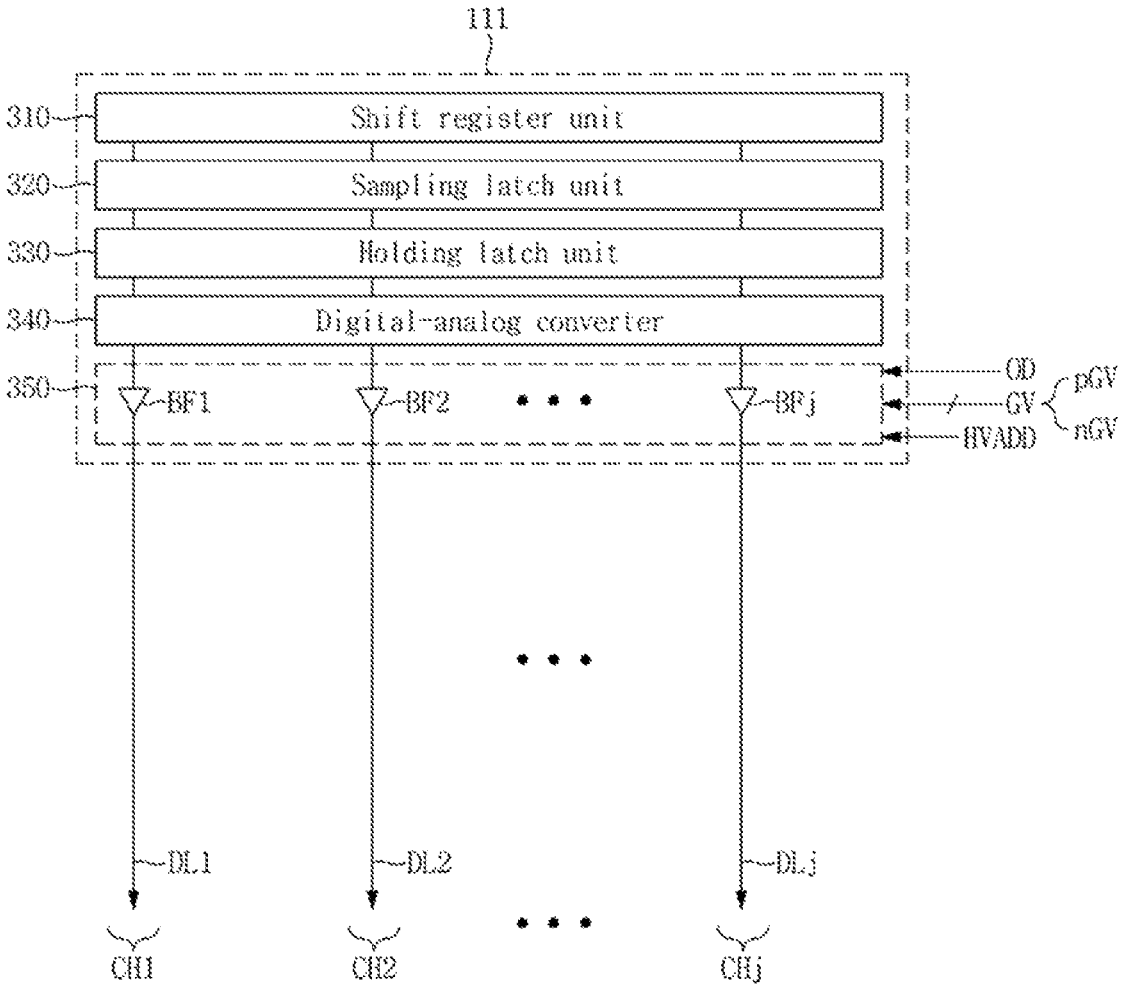
FIG. 15 a view illustrating yet other alternative components for overdriving of the display device illustrated in FIG. 3.

FIG. 15 a view illustrating yet other alternative components for overdriving of the display device illustrated in FIG. 3.

As illustrated in FIG. 15, a buffer unit 350 may receive an overdriving control signal OD. The overdriving control signal OD may be provided from the aforementioned timing controller 101 or the aforementioned overdriving determination unit 600.

The buffer unit 350 receiving the overdriving control signal OD of the active level outputs, during a horizontal blanking period ②, a data voltage having an opposite polarity to a polarity of a data voltage applied to a data line in a source output period immediately before the horizontal blanking period ②. For example, in the case where a positive polarity data voltage is applied to a first data line DL1 of a first channel CH1 in a previous source output period ①, a first buffer BF1 of the first channel CH1 applies a negative polarity data voltage to the first data line DL1 during the horizontal blanking period ②. The positive polarity data voltage may be one of positive polarity gray level voltages pGV and the negative polarity data voltage may be one of negative polarity gray level voltages nGV.

In the case where the overdriving control signal OD is applied from the timing controller 101, the entirety of buffers BF1 to BFj perform the overdriving operation at a substantially same time or do not perform the overdriving operation. On the other hand, in the case where a plurality of overdriving control signals OD1 to ODj having different levels from each other are provided from the overdriving determination unit 600, each of the buffers BF1 to BFj individually perform the overdriving operation or do not perform the overdriving operation based on the level of each corresponding overdriving control signal applied thereto.

Various components characterized above as a "unit" or other functional are inherently configured with electronic circuitry and may alternatively be called a "circuit". For example, the shift register unit, sampling latch unit, holding latch unit, buffer unit, switch control unit, overdriving blocking unit and overdriving determination unit may alternatively be called, respectively, a shift register circuit, sampling latch circuit, holding latch circuit, buffer circuit, switch control circuit, overdriving blocking circuit and overdriving determination circuit, or circuitry, electronic hardware, or the like. Similarly, the above-described timing controller, data driver, gate driver, DC-DC converter, gray level generator, comparator, overdriving interrupter and D/A converter are each configured with electronic circuitry and may alternatively be called, respectively, a timing controller circuit, data driver circuit, gate driver circuit, DC-DC converter circuit, gray level generator circuit, comparator circuit, overdriving interrupter circuit and D/A converter circuit, or the like. In some cases, a circuit may be a processor. A processor may be a special purpose processor or a general purpose processor that executes instructions loaded from a memory to effectively operate as a special purpose processor.

As exemplified by embodiments above, a display device according to the inventive concept may include, at least, a data driver configured to output a previous data voltage and a current data voltage, respectively, at an output terminal, to be applied to a pixel of a display panel, in respective time intervals. A switch may be controlled to open and close a circuit path between the output terminal and a data line coupled to the pixel. A capacitor may store an overdriving voltage. At least one further switch may selectively apply the overdriving voltage to the data line from the capacitor when the circuit path is open and thereby enable a rapid transition of a voltage level of the data line between the previous and current data voltages, when the current and previous data voltages are to differ by more than a predetermined amount.

As set forth hereinabove, a display device according to one or more exemplary embodiments may provide the following effects.

First, the data voltage of the data line may reach the target voltage rapidly within a predetermined period because the data voltage is overdriven using the positive polarity gray level voltage and the negative polarity gray level voltage stored in the capacitor. Accordingly, overdriving may be performed for the data voltage changing from a gray level of 0 to a higher gray level. Accordingly, the color mixture phenomenon between pixels connected to one data line and representing different colors is minimized. Thus, the image quality may be improved.

Second, the variation of the overdriving voltage due to resistance variation of the switch may be substantially minimized because the voltage of the data line is sensed by the comparator.

Third, when the voltage across the capacitor is outside a tolerance range of a predetermined value, the overdriving operation is interrupted, such that degradation in image quality may be substantially prevented.

While example embodiments have been illustrated and described, it will be apparent to those of ordinary skill in the art that various changes in form and detail may be made thereto without departing from the spirit and scope of the inventive concept as defined by the appended claims and their equivalents.

What is claimed is:

1. A display device comprising:

a timing controller configured to output an overdriving control signal that controls overdriving of a first data line, based on image data signals from a system;

a switch controller configured to output a first switch control signal and a second switch control signal based on a polarity control signal, a source output enable signal, a vertical synchronization signal and an overdriving control signal from the timing controller;

a first capacitor that stores an overdriving voltage used for the overdriving, the first capacitor being disposed outside a pixel, and the pixel comprising a second capacitor;

a first switch controlled according to the first switch control signal from the switch controller and connected between one terminal of the first capacitor and the first data line;

a second switch controlled according to the second switch control signal from the switch controller and connected between another terminal of the first capacitor and the first data line, the first data line being connected to the pixel;

a data driver configured to generate a first previous data voltage and a first current data voltage based on a first previous image data signal and a first current image data signal from the timing controller and to output the first previous data voltage and the first current data voltage through a first output terminal; and a third switch controlled according to a third switch control signal from the timing controller and connected between the first output terminal and the first data line.

2. The display device as claimed in claim 1, further comprising a gray level generator configured to generate a plurality of positive polarity gray level voltages and a plurality of negative polarity gray level voltages and apply the plurality of positive polarity gray level voltages and the plurality of negative polarity gray level voltages to the data driver.

3. The display device as claimed in claim 2, wherein, during a first half of a vertical blanking period defined by the vertical synchronization signal, the switch controller outputs, based on a level of the polarity control signal, one of the first switch control signal and the second switch control signal in an active level and the other of the first switch control signal and the second switch control signal in an inactive level, and the timing controller outputs the third switch control signal of an inactive level.

4. The display device as claimed in claim 3, wherein, during a second half of the vertical blanking period, the switch controller outputs the first switch control signal of an inactive level and the second switch control signal of an inactive level, the timing controller outputs the third switch control signal having an active level, and the data driver outputs an initialization voltage through the first output terminal.

5. The display device as claimed in claim 3, further comprising:

a fourth switch controlled according to the first switch control signal from the switch controller and connected between said another terminal of the first capacitor and a second data line;

a fifth switch controlled according to the second switch control signal from the switch controller and connected between said one terminal of the first capacitor and the second data line; and a sixth switch controlled according to the third switch control signal from the timing controller and connected between a second output terminal of the data driver and the second data line, wherein the data driver generates a second previous data voltage and a second current data voltage based on a second previous image data signal and a second current image data signal from the timing controller and sequentially outputs the second previous data voltage and the second current data voltage through the second output terminal, and the first previous data voltage has an opposite polarity to a polarity of the second previous data voltage and the first current data voltage has an opposite polarity to a polarity of the second current data voltage.

6. The display device as claimed in claim 5, wherein, during the first half of the vertical blanking period, the first switch and the fourth switch are turned on and the second switch, the third switch and the fifth switch are turned off by the switch controller, a voltage from the first data line is applied to said another terminal of the capacitor through the turned-on first switch and a voltage from the second data line is applied to said another terminal of the capacitor through the turned-on fourth switch, and the voltage of the first data line and a voltage of the second data line have mutually opposite polarities.

7. The display device as claimed in claim 1, wherein the image data signals input to the timing controller comprise previous image data signals and current image data signals, and the timing controller outputs the overdriving control signal having an active level when each of the previous image data signals is greater than or equal to a first reference value and each of the current image data signals is less than or equal to a second reference value.

8. The display device as claimed in claim 7, wherein the first reference value has a digital value corresponding to an intermediate gray level voltage and the second reference value has a digital value corresponding to a minimum gray level voltage.

9. The display device as claimed in claim 1, wherein, during a horizontal blanking period defined by the source output enable signal, when the overdriving control signal having an active level is output from the timing controller, the switch controller outputs, during the horizontal blanking period, based on a level of the polarity control signal, one of the first switch control signal and the second switch control signal in an active level and the other of the first switch control signal and the second switch control signal in an inactive level, and the timing controller outputs the third switch control signal of an inactive level during the horizontal blanking period.

10. The display device as claimed in claim 9, wherein the switch controller outputs the first switch control signal having an active level and the second switch control signal of an inactive level when the polarity control signal has a first level, and the switch controller outputs the first switch control signal of an inactive level and the second switch control signal having an active level when the polarity control signal has a second level.

11. The display device as claimed in claim 9, wherein, during a horizontal blanking period between an output period of the first previous data voltage and an output period of the first current data voltage, the switch controller outputs one of the first switch control signal having an active level and the second switch control signal of an inactive level.

12. The display device as claimed in claim 1, further comprising a selection unit configured to select one of a first reference voltage and a second reference voltage based on the polarity control signal during a horizontal blanking period defined by the source output enable signal; and a comparator for comparing the reference voltage selected by the selection unit with a voltage of the first data line and applying a comparison signal based on the comparison to the switch controller during the horizontal blanking period.

13. The display device as claimed in claim 12, wherein the switch controller outputs the first switch control signal of an inactive level and the second switch control signal of an inactive level when the comparison signal of an active level is output from the comparator.

14. The display device of claim 1, wherein the first capacitor maintains a negative polarity overdriving voltage for the overdriving at said one terminal of the first capacitor and the first capacitor maintains a positive polarity overdriving voltage at said another terminal of the first capacitor.

15. The display device of claim 1, wherein said one terminal of the first capacitor is switchedly connected to a second data line of the display device through a fourth switch and said another terminal of the first capacitor is switchedly connected to the second data line of the display device through a fifth switch.

16. A display device comprising:

a timing controller configured to output an overdriving control signal based on image data signals from a system;

a switch controller configured to output a first switch control signal and a second switch control signal based on a polarity control signal, a source output enable signal, a vertical synchronization signal and an overdriving control signal from the timing controller;

a capacitor;

a first switch controlled according to the first switch control signal from the switch controller and connected between one terminal of the capacitor and a first data line;

a second switch controlled according to the second switch control signal from the switch controller and connected between another terminal of the capacitor and the first data line;

a data driver configured to generate a first previous data voltage and a first current data voltage based on a first previous image data signal and a first current image data signal from the timing controller and to output the first previous data voltage and the first current data voltage through a first output terminal;

a third switch controlled according to a third switch control signal from the timing controller and connected between the first output terminal and the first data line;

a gray level generator configured to generate a plurality of positive polarity gray level voltages and a plurality of negative polarity gray level voltages and apply the plurality of positive polarity gray level voltages and the plurality of negative polarity gray level voltages to the data driver;

a first comparator for comparing a voltage of said one terminal of the capacitor with a first reference voltage and outputting a first comparison signal based on a result of the comparison;

a second comparator for comparing a voltage of said another terminal of the capacitor with a second reference voltage and outputting a second comparison signal based on a result of the comparison with the second reference voltage; and an overdriving interrupter circuit for outputting an overdriving interruption signal based on the first and second comparison signals from the first and second comparators and applying the overdriving interruption signal to the switch controller.

17. The display device as claimed in claim 16, wherein the first reference voltage has a substantially same magnitude as a magnitude of a minimum negative polarity gray level voltage and the second reference voltage has a substantially same magnitude as a magnitude of a minimum positive polarity gray level voltage.

18. The display device as claimed in claim 16, wherein the overdriving interrupter circuit outputs the overdriving interruption signal of an active level when at least one of the first and second comparison signals has an active level, and the switch controller outputs the first switch control signal of an inactive level and the second switch control signal of an inactive level according to the overdriving interruption signal of the active level.

* * * * *